US007528799B2

(12) United States Patent
Inukai

(10) Patent No.: US 7,528,799 B2
(45) **Date of Patent: *May 5, 2009**

(54) DISPLAY DEVICE, LIGHT EMITTING DEVICE, AND ELECTRONIC EQUIPMENT

(75) Inventor: Kazutaka Inukai, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 828 days.

This patent is subject to a terminal disclaimer.

(21) Appl. No.: 10/939,360

(22) Filed: Sep. 14, 2004

(65) Prior Publication Data

US 2005/0030304 A1 Feb. 10, 2005

Related U.S. Application Data

(63) Continuation of application No. 10/375,015, filed on Feb. 28, 2003, now Pat. No. 6,798,148.

(30) Foreign Application Priority Data

Mar. 1, 2002 (JP) ..... 2002-056555
Aug. 30, 2002 (JP) ..... 2002-256232

(51) Int. Cl.
*G09G 3/20* (2006.01)

(52) U.S. Cl. ..... 345/55; 345/76

(58) Field of Classification Search ..... 345/87–100, 345/204, 76, 77, 84, 905; 315/169.1, 169.4, 315/169.3; 257/59, 72; 365/177
See application file for complete search history.

(56) References Cited

U.S. PATENT DOCUMENTS 6,344,843 B1 2/2002 Koyama et al.
6,359,605 B1 3/2002 Knapp et al.
6,501,466 B1 12/2002 Yamagishi et al.
6,583,775 B1 6/2003 Sekiya et al.
6,611,107 B2 8/2003 Mikami et al.
6,791,129 B2 9/2004 Inukai (Continued)

FOREIGN PATENT DOCUMENTS

EP 1 061 497 12/2000

(Continued)

OTHER PUBLICATIONS

International Search Report (Application No. 03004551.2) dated Sep. 28, 2007, 5 pages.

(Continued)

*Primary Examiner*—Nitin Patel
(74) *Attorney, Agent, or Firm*—Fish & Richardson P.C.

(57) ABSTRACT

An AM-OLED display device is provided in which dispersion in OLED element driver currents is sufficiently suppressed is taken as an objective. The present invention places a plurality of transistors into a parallel connection state during write-in of a data current into pixels, and places the plurality of transistors into a series connection state when light emitting elements emit light. As a result, even if dispersions exist between the plurality of transistors structuring a driver element within the same pixel, the influence of the dispersions can be greatly suppressed, and therefore irregularities in the brightness of emitted light across pixels, of an order such that it causes problems in practical use, can be prevented.

16 Claims, 17 Drawing Sheets

U.S. PATENT DOCUMENTS

| | | | | |
|---|---|---|---|---|
| 6,798,148 | B2 * | 9/2004 | Inukai | 315/169.3 |
| 6,995,520 | B2 | 2/2006 | Inukai | |
| 7,164,404 | B2 * | 1/2007 | Senda et al. | 345/90 |
| 2002/0033718 | A1 | 3/2002 | Tam | |
| 2002/0047817 | A1 | 4/2002 | Tam | |
| 2003/0058687 | A1 | 3/2003 | Kimura | |
| 2003/0142046 | A1 | 7/2003 | Kasai et al. | |

FOREIGN PATENT DOCUMENTS

| | | | |
|---|---|---|---|
| EP | 1 102 234 | | 5/2001 |
| EP | 1 103 946 | | 5/2001 |
| EP | 1 150 273 | | 10/2001 |
| EP | 1 170 718 | | 1/2002 |
| EP | 1 282 103 | A2 | 2/2003 |
| JP | 2001-060076 | | 3/2001 |
| JP | 2001-147659 | | 5/2001 |
| JP | 2001-343933 | | 12/2001 |
| JP | 2002-023697 | | 1/2002 |
| WO | WO99-65012 | | 12/1999 |

OTHER PUBLICATIONS

Yu-Wu Wang et al., "A New Pixel Design for Improving the Uniformity on Active Matrix OLED", Asia Display '01 : Proceedings of the 8th International Display Research Conference, Oct. 16, 2001, pp. 323-326.

Examination Report (Singapore Patent Application No. 200300771-3) dated Feb. 25, 2005.

Kurita et al.; Requirements for LCD to Gain High Moving Image Quality ~ Improvement of Quality Degraded by Hold-Type Display ~; *AM-LCD 2000*; pp. 1-4; 2000.

Hunter et al.; "Active Matrix Addressing of Polymer Light Emitting Diodes Using Low Temperature Poly Silicon TFTs"; *AM-LCD 2000*; pp. 249-252; 2000.

Hunter et al.; "Performance of p-Si pixel circuits for Active Matrix Polymer LED Displays"; *AM-LCD '01*; pp. 215-218; 2001.

Yumoto et al.; "Pixel-Driving Methods for Large-Sized Poly-Si AM-OLED Displays"; *Asia Display / IDW '01*; pp. 1395-1398; 2001.

* cited by examiner

DISPLAY DEVICE, LIGHT EMITTING DEVICE, AND ELECTRONIC EQUIPMENT

CROSS-REFERENCE TO RELATED APPLICATIONS

This application is a continuation application of U.S. application Ser. No. 10/375,015, filed Feb. 28, 2003 now U.S. Pat. No. 6,798,148, which claims the benefit of foreign priority applications filed in Japan as Ser. No. 2002-056555 on Mar. 1, 2002, and as Ser. No. 2002-256232 on Aug. 30, 2002. This application claims priority to each of these prior applications, and the disclosures of the prior applications are considered part of (and are incorporated by reference in) the disclosure of this application.

BACKGROUND OF THE INVENTION

1. Field of the Invention

The present invention relates to a light emitting device and to a display device. In addition, the present invention relates to electronic equipment in which the light emitting device or the display device is mounted. The term light emitting device as used in this specification indicates devices that utilize light emitted from a light emitting element. Examples of the light emitting elements include organic light emitting diode (OLED) elements, inorganic material light emitting diode elements, field emission light emitting elements (FED elements) and the like. The term display device as used in this specification indicates devices in which a plurality of pixels are arranged in a matrix shape, and image information is visually transmitted, namely displays.

2. Description of the Related Art

The importance of display devices that perform display of images and pictures has continued to increase in recent years. Due to their advantages such as high image quality, thin size, and light weight, liquid crystal display devices that perform display of an image by using liquid crystal elements are widely utilized in various types of display devices, such as portable telephones and personal computers.

On the other hand, the development of display devices and light emitting devices that use light emitting elements is also advancing. Elements that use many different types of materials over a wide-ranging area, such as organic materials, inorganic materials, thin film materials, bulk materials, and dispersed materials exist as light emitting elements.

Organic light emitting diodes (OLEDs) are typical light emitting elements currently seen as promising for all types of display devices. OLED display devices that use OLED elements as light emitting elements are thinner and lighter than existing liquid crystal display devices, and in addition, have characteristics such as high response speed suitable for dynamic image display, a wide angle of view, and low voltage drive. A wide variety of applications are therefore anticipated, from portable telephones and portable information terminals (PDAs) to televisions, monitors, and the like. OLED display devices are under the spotlight as next generation displays.

In particular, active matrix (AM) OLED display devices are capable of high resolution (large number of pixels), high definition (fine pitch), and a large screen display, all of which are difficult for passive matrix (PM) type displays. In addition, AM-OLED display devices have high reliability at lower electric power consumption operation than that of passive matrix OLEDs, and there are very strong expectations that they will be put into practical use.

OLED elements are structured by an anode, a cathode, and an organic compound containing layer sandwiched between the anode and the cathode. Normally the brightness of light emitted from the OLED element is roughly proportional to the amount of electric current flowing in the OLED element. A driver transistor that controls the light emission brightness of a pixel OLED element is inserted in series with the OLED element in AM-OLED display device pixels.

Voltage input methods and current input methods exist as driving methods for displaying images in AM-OLED display devices. The voltage input method is a method in which a voltage value data video signal is input to the pixels as an input video signal. On the other hand, the current input method is a method in which a current value video signal is input to the pixels as an input video signal.

The video signal voltage is normally applied directly to a gate electrode of a pixel driver transistor in the voltage input method. If there is dispersion, not uniformity, in the electrical characteristics of the driver transistors across each of the pixels when the OLED elements emit light at a constant current, then dispersion will develop in the OLED element driver current of each of the pixels. Dispersion in the OLED element driver current becomes dispersion in the brightness of light emitted from the OLED elements. Dispersion in the brightness of light emitted by the OLED elements reduces the quality of the displayed image as a sandstorm state or carpet-like pattern unevenness is seen over an entire screen. Stripe shape unevenness is also found, depending upon the manufacturing process.

In particular, a relatively large electric current is necessary in order to obtain a sufficiently high brightness when OLED elements presently capable of being used, which have low light emission efficiency, are applied as a light emitting device. As a result, it is difficult to use amorphous silicon thin film transistors (TFTs), which have low current capacity, as the driver transistors. Polycrystalline silicon (polysilicon) TFTs are therefore used as the driver transistors. However, there is a problem with polysilicon in that dispersions in the TFT electrical characteristics are likely to develop due to causes such as faults in the crystal grain boundaries.

The current input method can be used as one effective means in order to prevent dispersion in the OLED element driver current that occurs in this type of voltage input method. A video signal data current value is normally stored with the current input method, and an electric current identical to, or several times as large as, the value of the stored electric current (positive real number multiples, including those less than 1) is supplied as the OLED element driver current.

A typical known example of a pixel circuit of a current input method AM-OLED display device is shown in FIG. 10A (refer to Non-Patent Document 1). Reference numeral 516 denotes an OLED element. This pixel circuit uses a current mirror circuit. Video signal data current values can be accurately stored as long as two transistors structuring the current mirror have identical electrical characteristics. Even if there is dispersion in the electrical characteristics of the driver transistors of different pixels, dispersion in the brightness of light emitted by the OLED elements can be prevented as long as the two transistors within the same pixel each have identical electrical characteristics.

Another typical known example of a pixel circuit of a current input method AM-OLED display device is shown in FIG. 10B (refer to Non-Patent Document 2). Reference numeral 611 denotes an OLED element. This pixel circuit has a short circuit between a drain electrode, and a gate electrode, of a driver transistor itself when a voltage corresponding to a video signal is written into the gate electrode of the driver transistor. A video signal data current is made to flow in this state, and the gate electrode is then electrically insulated. By doing so, an electric current having a value identical to the data current during write-in is supplied to the OLED element by the driver transistors, provided that the driver transistors are operated in the saturated region. Dispersion in the brightness of light emitted by the OLED elements can therefore be prevented, even if dispersion exists in the electrical characteristics of the driver transistors of each pixel.

[Non-Patent Document 1] Yumoto, A., et al., Proc. Asia Display/IDW '01, pp. 1395-1398 (2001).

[Not-Patent Document 2] Hunter, I. M., et al., Proc. AM-LCD 2000, pp. 249-252 (2000).

The data current value should be able to be accurately stored with FIGS. 10A and 10B, as discussed above, but there are serious problems as stated below.

First, a problem with the pixel circuit of FIG. 10A is that there is a precondiction in which the two transistors 512 and 513 that structure the current mirror must have identical electrical characteristics. Provided that it is considered during design, it is possible to manufacture both transistors adjacently on a substrate, and dispersion can be reduced to a certain extent. However, dispersions in the electrical characteristics of TFTs, such as threshold voltage and field effect mobility, that exceed a permissible limit normally remain in present-day polysilicon due to causes such as faults in the crystal grain boundaries.

Specifically, it becomes necessary to keep brightness within a range on the order of 1%, for example, if a 64 gray scale image is displayed. However, storing the data current values at a precision of 1% with the pixel circuit of FIG. 10A is difficult to achieve with the polysilicon normally in use at present. In other words, a sufficiently uniform, high quality display image over an entire screen. without irregularities, cannot be obtained by only using the pixel circuit of FIG. 10A.

Next, the fact that the video signal data current written into the pixel has the identical value to the OLED element driver current when the OLED element emits light is a problem with the pixel circuit of FIG. 10B. The fact that both electric currents must have identical values is a very severe restriction in practice when manufacturing an AM-OLED display device.

Specifically, a large amount of parasitic capacitance and parasitic resistance exists in signal lines and the like in an actual AM-OLED display device. As a result, it often becomes necessary to take steps to make the video signal data current larger than the OLED element driver current. In particular, it becomes extremely difficult to write in the video signal data current of dark portions for cases in which the video signal data current is made into an analog value for gray scale expression.

SUMMARY OF THE INVENTION

The present invention has been made in view of the aforementioned problem points. First, an object of the present invention is to provide an AM-OLED display device in which the ratio between a video signal data current written into a pixel, and an OLED element driver current during OLED element light emission, is not fixed to a value of "1", differing from the pixel circuit of FIG. 10B. Next, the present invention is premised on the fact that it is possible for dispersion in electric characteristics to remain to a certain extent, even between transistors placed adjacently within the same pixel, differing from the pixel circuit of FIG. 10A. Therefore, another object of the present invention is to provide an AM-OLED display device in which dispersion in the OLED element driver currents is sufficiently inhibited compared to pixel circuits that use a current mirror like that of FIG. 10A.

Note that the constitution of the present invention can be effectively utilized when using current driven elements in display devices and light emitting devices that use elements other than OLED elements.

In order to solve the aforementioned objectives, the present invention is characterized in that driver elements disposed in each pixel of an AM display device or a light emitting device are structured by a plurality of transistors, the plurality of transistors are placed in a parallel connection state when a data current is written into the pixel, and the plurality of transistors are placed in a series connection state when a light emitting element emits light.

Note that the constitution of the present invention can be utilized when using current driven elements in display devices and light emitting devices that use elements other than OLED elements.

An outline of the pixel structure of this type of display device or light emitting device of the present invention is explained using FIGS. 1A and 1B. FIG. 1A shows a pixel 11 disposed in a j-th row and an i-th column in a pixel portion having a plurality of pixels. The pixel 11 has a signal line (Si), a power source line (Vi), a first scanning line (Gaj), a first switch 12 having a switching function, a second switch 13 having a switching function, a third switch 14 having a switching function, a driver element 15, a capacitor element 16, and a light emitting element 17. Note that it is not always necessary to form the capacitor element 16 for cases such as those where the parasitic capacitance of a node at which the capacitor element 16 is disposed is large.

An OLED element is typically applied as the light emitting element, and therefore a diode reference symbol may also be used in this specification as a reference symbol that expresses the light emitting element. However, diode characteristics are not necessary in the light emitting element, and the present invention is not limited to light emitting elements that possess diode characteristics. In addition, the light emitting elements in this specification may be current driven display elements, and it is not necessary that the elements have a display function due to emitted light. For example, light shutters such as liquid crystals that can be controlled by electric current values, not voltage values, are also included in the category of light emitting elements in this specification.

One semiconductor element, or a plurality of semiconductor elements, having a switching function, such as a transistor can be used in the first switch 12, the second switch 13, and the third switch 14. A plurality of semiconductor elements such as transistors can also be used similarly in the driver element 15. On and off states for the first switch 12 and the second switch 13 are determined by signals imparted from the first scanning line (Gaj). It is sufficient that the first switch 12 and the second switch 13 function as switching elements, and therefore no particular limitations are placed on the conductivity type of the semiconductor elements used.

Note that the first switch 12 located between the signal line (Si) and the driver element 15, and plays a role in controlling signal write-in to the pixel 11. Further, the second switch 13 is located between the power source line (Vi) and the driver element 15, and controls the supply of electric current form the power source line to the pixel 11.

A case of additionally disposing a fourth switch 18 and a second scanning line (Gbj) in the pixel 11 of FIG. 1A is shown in FIG. 1B. One semiconductor element, or a plurality of semiconductor elements, having a switching function, such as transistors, can be used in the fourth switch 18. On and off states for the fourth switch 18 are determined by signals imparted from the second scanning line (Gbj). It is sufficient that the first switch 12 and the second switch 13 function as switching elements, and therefore no particular limitations are placed on the conductivity type of the semiconductor elements used.

Note that the fourth switch 18 plays a role as an initialization element for the pixel 11. Electric charge stored in the capacitor element 16 is released if the fourth switch 18 turns on, the driver element 15 turns off, and in addition, light emission by the light emitting element 17 stops.

The present invention is characterized in that the driver element 15 is structured by a plurality of transistors, and the connection between the plurality of transistors is switched to a parallel connection for cases in which a video signal data current is written into the pixel 11, or to a serial connection for cases in which electric current flows in the light emitting element 17, which thus emits light. On and off control of the first switch 12 and the second switch 13 by signals from the scanning line (Gaj) in FIGS. 1A and 1B becomes a means for switching the plurality of transistors in the driver element 15 between a parallel connection state and a series connection state.

Examples of the pixel 11 for a case of structuring the driver element 15 by using four transistors 20*a*, 20*b*, 20*c*, and 20*d* are shown in FIGS. 1C and 1D. Explanations of current pathways in the pixel 11 are provided below.

FIG. 1C shows a case of writing a data current into the pixel 11, and FIG. 1D shows a case of the light emitting element emitting light. Note that elements other than the first switch 12, the second switch 13, the driver element 15, the light emitting element 17, the signal line (Si), and the power source line (Vi) are not shown in FIGS. 1C and 1D.

A case in which a data current is written into the pixel 11 is explained first. The first switch 12 and the second switch 13 turn on due to a signal imparted from the first scanning line (Gaj) in FIG. 1C. Each transistor in the driver element 15 is thus placed in a diode connected state, and all of the transistors are mutually connected in a parallel connection state. A current pathway exists from the power source line (Vi), through the second switch 13, the driver element 15, and the first switch 12, to the signal line (Si). A current value $I_W$ at this point is the data current value of the video signal, and is a predetermined current value output to the signal line (Si) by a signal line driver circuit.

A case in which the light emitting element 17 emits light is explained next. The first switch 12 and the second switch 13 are turned off by a signal imparted from the first scanning line (Gaj) in FIG. 1D. Each of the transistors in the driver element 15 are thus mutually connected in a series connection state. A current pathway exists from the power source line (Vi), through the transistors 20*a*, 20*b*, 20*c*, and 20*d*, to the light emitting element 17. The brightness of light emitted by the light emitting element 17 is determined by a current value $I_E$ at this point.

As discussed above, the transistors 20*a* to 20*d* that structure the driver element 15 are used in parallel with the present invention during write-in of the data current to the pixel (see FIG. 1C). In addition, the transistors 20*a* to 20*d* that structure the driver element 15 are used in series when electric current flows in the light emitting element 17 of the pixel 11, that is when the light emitting element is driven (see FIG. 1D). The current value $I_W$ during write-in therefore becomes 16 times ($4^2$ times) the current value $I_E$ during light emitting element drive, if it is assumed that the electrical characteristics of the transistors 20*a* to 20*d* are identical. In general, if the number of transistors structuring the driver element 15 is considered to be n, then a relationship shown by Eq. 1 is established between the current value $I_W$ during video signal write-in and the current value $I_E$ during light emitting element drive, under the condition that all of the transistors have identical electrical characteristics.

$$I_W = n^2 \times I_E \tag{1}$$

Here, n is preferably between 3 and 5. Note that, in order to strictly establish Eq. 1, there is a condition that all of the transistors structuring the driver element 15 must possess identical electrical characteristics. However, it is possible in practice to treat Eq. 1 as if approximately established, even for cases involving a slight amount of mutual dispersion in the electrical characteristics of the transistors.

Thus, the present invention is characterized in that the driver element 15 is structured by the plurality of transistors, and the current value $I_W$ during write-in, and the current value $I_E$ during light emitting element drive, can therefore be arbitrarily set by switching the connection between the plurality of transistors between parallel and serial for cases of writing a video signal current into the pixel 11 and for cases of the light emitting element emitting light.

Further, the present invention is also characterized in that the influence of slight, mutual differences in the electrical characteristics of each of the transistors structuring the driver element 15 can be greatly reduced from being reflected in the light emitting element drive current $I_E$. A specific example of this is taken up and explained in an embodiment mode.

Even with a pixel circuit using a current mirror like that of FIG. 10A, there is a problem in that identical electrical characteristics are required for the two transistors within the pixel. However, even the transistors within the same pixel are already presupposed to have slightly different electrical characteristics in the present invention. That is, the present invention is superior compared to pixel circuits that use current input method current mirrors in that the present invention has tolerance for dispersions in the characteristics of the transistors. As a result, it becomes possible to make the light emitting element driver current $I_E$ uniform to a level at which it can be put into practical use, even if dispersions in the electrical characteristics of polysilicon TFTs, caused by defects in crystal grain boundaries and the like, exist.

The display device and the light emitting device of the present invention are display devices provided with a plurality of pixels. The pixels each have a driver element provided with a light emitting element and a plurality of transistors. The display device and the light emitting device of the present invention are characterized by including a means capable of making, at minimum, a state in which the plurality of transistors in the driver element are connected in parallel, and a state in which the plurality of transistors in the driver element are connected in series. The term light emitting device as used in this specification indicates devices that utilize light emitted form a light emitting element. Examples of light emitting elements include organic light emitting diode (OLED) elements, inorganic material light emitting diode elements, and field emission light emitting elements (FED elements). The term display device as used in this specification indicates devices in which a plurality of pixels are arranged in a matrix shape, and image information is transferred visually, namely displays.

An outline of a pixel structure of the display device and the light emitting device of the present invention that differs from that of FIGS. 1A and 1B is explained here using FIGS. 11A and 11B. The pixel 11 disposed in the j-th row and the i-th column in the pixel portion having a plurality of pixels is shown in FIG. 11A. The pixel 11 of FIG. 11A is provided with a signal line (Si), a power source line (Vi), a first scanning line (Gaj), a second scanning line (Gbj), a third scanning line (Gcj), a fourth scanning line (Gdj), a first switch 312, a second switch 313, a third switch 314, a fourth switch 318, a driver element 315, a capacitor element 316, a light emitting element 317, and an opposing electrode 319, for example. However, even if the structure with the first switch, the second switch, the third switch, the fourth switch, the first scanning line (Gaj), the second scanning line (Gbj), the third scanning line (Gcj), the fourth scanning line (Gdj), and the like is changed slightly, in practice the same device can be obtained. One example of such is FIG. 11B. The fourth switch is removed, and the third scanning line is unified with the second scanning line in FIG. 11B. This is also identical in practice to FIG. 11A, and in the absence of any specific limitations, is taken as being included in FIG. 11A. Cases of adding components such as initialization elements are also similarly treated.

Note that the capacitor element 316 does not always have to be expressly formed in FIGS. 11A and 11B for cases in which the parasitic capacitance of a node at which the capacitor element 316 is disposed is large, and the like.

A single semiconductor element, or a plurality of semiconductor elements, having a switching function such as transistors, can be used in the first switch 312, the second switch 313, the third switch 314, and the fourth switch 318. A plurality of semiconductor elements such as transistors can also be similarly used in the driver element 315. There are no particular limitations placed on the conductivity type (n-channel, p-channel) of the semiconductor elements used in the first switch 312, the second switch 313, the third switch 314, the fourth switch 318, and the driver element 315. This is mostly because n-channel and p-channel types can both be used, and there are cases in which a specified conductivity type is more preferable than another conductivity type for specific applied examples.

A signal imparted from the first scanning line (Gaj) determines whether the first switch 312 is on or off. Similarly, a signal form the second scanning line (Gbj) determines whether the second switch 313 is on or off, a signal from the third scanning line (Gcj) determines whether the third switch 314 is on or off, and a signal from the fourth scanning line (Gdj) determines whether the fourth switch 318 is on or off. It is of course not necessary for all of the scanning lines, the first scanning line (Gaj), the second scanning line (Gbj), the third scanning line (Gcj), and the fourth scanning line (Gdj), to exist, and a certain scanning line can also be combined with other scanning lines, as is made clear by FIG. 11B.

The first switch 312 is disposed between the signal line (Si) and the driver element 315 in FIG. 1A, and serves a role for controlling signal write-in to the pixel 11. Further, the second switch 313 and the fourth switch 318 are disposed between the power source line (Vi) and the driver element 315, and perform on and off control of the supply of electric current form the power source line (Vi) to the pixel 11. The third switch 314 is disposed between the driver element 315 and the light emitting element 317, and performs on and off control of the supply of electric current form the driver element 315 to the light emitting element 317.

In the present invention, the driver element 315 is structured by the plurality of transistors, and the plurality of transistors are connected in parallel when a video signal data current is written into the pixel 11. The plurality of transistors are connected in series when electric current flows in the light emitting element 317, and light is emitted. It becomes possible to place the plurality of transistors in the driver element 315 in a parallel connection state, and also in a series connection state, by controlling the on and off states of the first switch, the second switch, the third switch, and the fourth switch using the signals from the scanning lines (Gaj, Gbj, Gcj, and Gdj) in FIG. 11A.

The pixel 11 is shown in FIGS. 11C and 11D here as an example of a case in which the driver element 315 is structured by four transistors 320*a*, 320*b*, 320*c*, and 320*d*. Electric current pathways in the pixel 11 are explained below.

FIG. 11C shows a case of writing a data current into the pixel 11, and FIG. 11D shows a case of the light emitting element emitting light. With FIG. 11C, the four transistors 320*a*, 320*b*, 320*c*, and 320*d* are in a parallel connection state, while the four transistors 320*a*, 320*b*, 320*c*, and 320*d* are in a series connection state in FIG. 11D. Note that element and wirings other than the first switch 312, the second switch 313, the driver element 315, the light emitting element 317, the source signal line (Si), and the power source line (Vi) are omitted from being shown in FIGS. 11C and 11D.

A case of writing a data current into the pixel 11 is explained first. The first switch 312 and the second switch 313 are turned on in FIG. 11C by signals imparted from the first scanning line (Gaj) and the second scanning line (Gbj), respectively. Each of the transistors in the driver element 315 is thus placed into a diode connected state, and the transistors are thus mutually placed in a parallel connection state. The third switch 314 and the fourth switch 318 turn off by signals input from the third scanning line (Gcj) and the fourth scanning line (Gdj), respectively. A current pathway exists from the power source line (Vi), through the second switch 313, the driver element 315, and the first switch 312, to the signal line (Si) when the power source line (Vi) has a high electric potential. The opposite is naturally true if the power source line (Vi) has a low electric potential. The current value $I_W$ is the value of the video signal data current at this point, and is a predetermined current value output to the signal line (Si) from a signal line driver circuit.

A case of the light emitting element 317 being made to emit light is explained next. The first switch 312 and the second switch 313 are turned off by signals imparted form the first scanning line (Gaj) and the second scanning line (Gbj), respectively, in FIG. 11D. The transistors in the driver element 315 are thus mutually placed in a series connection state. The third switch 314 and the fourth switch 318 turn off due to signals imparted form the third scanning line (Gcj) and the fourth scanning line (Gdj), respectively. A current pathway exists from the power source line (Vi), through the transistors 310*a*, 320*b*, 320*c*, and 320*d*, and to the light emitting element 317 when the power source line (Vi) has a high electric potential. The opposite is naturally true if the power source line (Vi) has a low electric potential. The current value $I_E$ determines the brightness of light emitted by the light emitting element 317 at this point.

The transistors 320*a*, 320*b*, 320*c*, and 320*d* that structure the driver element 315 are used parallelly when writing a data current into the pixel in the present invention (see FIG. 11C). On the other hand, the transistors 320*a*, 320*b*, 320*c*, and 320*d* that structure the driver element 315 are used serially when electric current flows in the light emitting element 317 of the pixel 11, that is when the light emitting element is driven (see FIG. 11D). The current value $I_W$ during write-in therefore becomes 16 ($4^2$) times the current value $I_E$ when the light emitting element is driven, provided that the electrical characteristics of the transistors 320*a*, 320*b*, 320*c*, and 320*d* are presumed to be identical. In general, if the number of transistors structuring the driver element 15 is considered to be n, then the relationship shown by Eq. 1 is established between the current value $I_W$ during video signal write-in and the current value $I_E$ during light emitting element drive, under the condition that all of the transistors have identical electrical characteristics.

DETAILED DESCRIPTION OF THE PREFERRED EMBODIMENTS

Embodiment Mode 1

An outline of a pixel of a display device and a light emitting device of the present invention has been discussed above using FIGS. 1A to 1D. A specific example of a pixel of a display device and a light emitting device of the present invention is explained in Embodiment Mode 1 using FIGS. 2A to 4B. For simplification, cases in which n, the number of transistors structuring the driver element 15, is from two to four are given as examples.

Figure 1A:
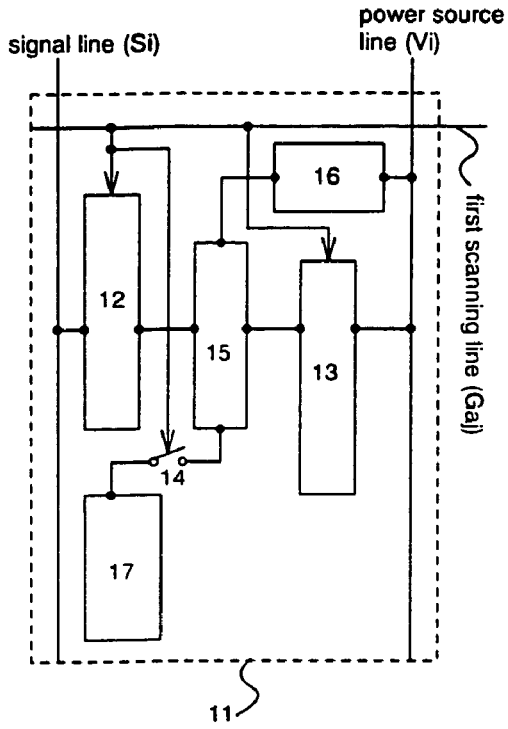
FIGS. 1A to 1D are diagrams showing a pixel of a display device and a light emitting device of the present invention.
Figure 1B:
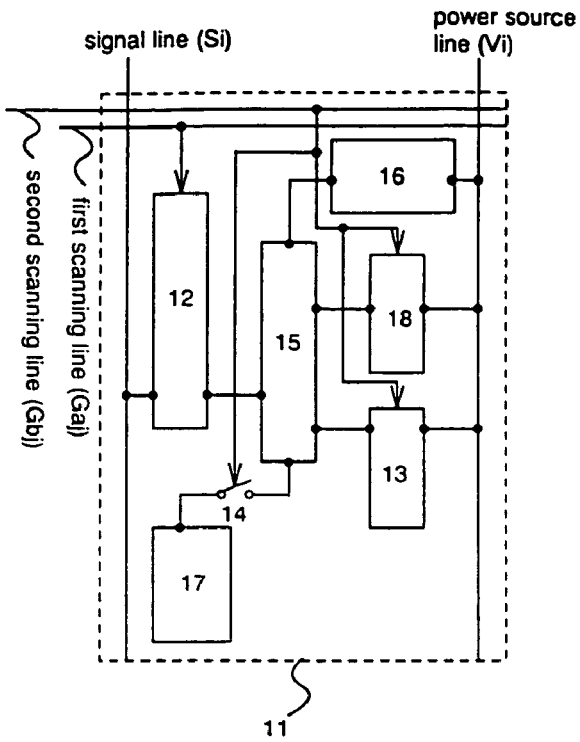
Figure 1C:
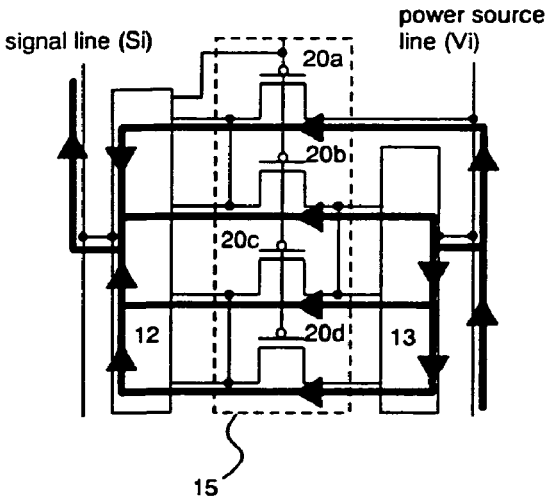
Figure 1D:
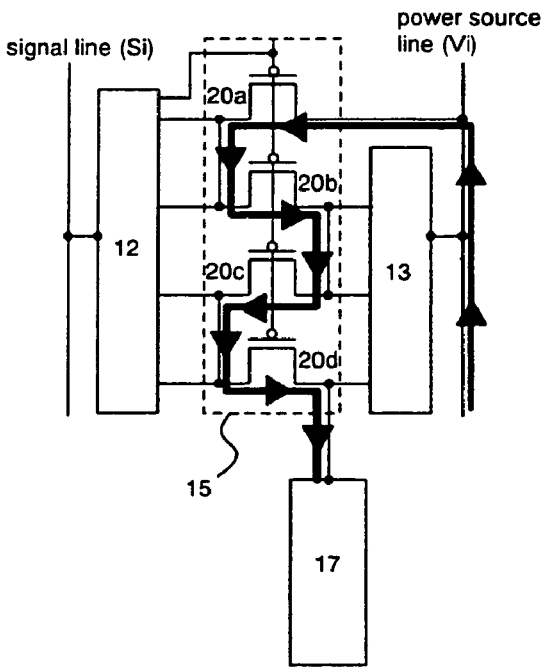
Figure 2A:
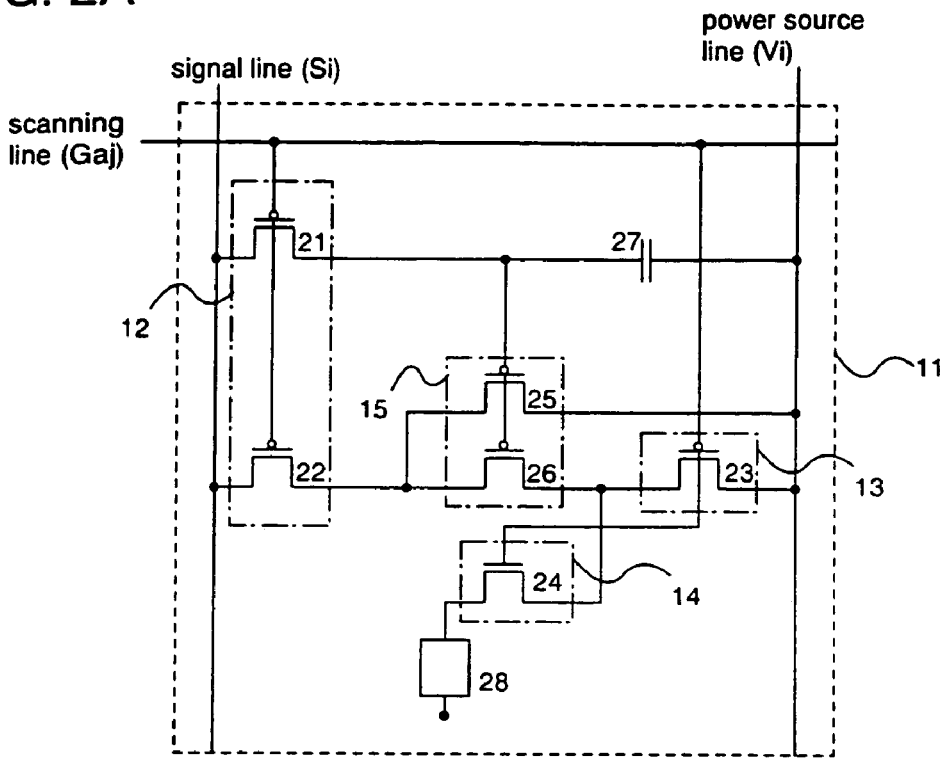
FIGS. 2A and 2B are diagrams showing a pixel of a display device and a light emitting device of the present invention.

A first example is explained using FIG. 2A.

The pixel 11 disposed in the j-th row and the i-th column is shown in FIG. 2A. The pixel 11 has a signal line (Si), a power source line (Vi), a scanning line (Gaj), transistors 21 to 26, a capacitor element 27, and a light emitting element 28. The pixel 11 shown in FIG. 2A is the pixel 11 shown in FIG. 1A, but shown specifically by transistors. The transistors 21 and 22, which are p-channel, correspond to the first switch 12. The transistor 23, which is p-channel, corresponds to the second switch 13, and the transistor 24, which is n-channel, corresponds to the third switch 14. The transistors 25 and 26, which are p-channel, correspond to the driver element 15.

Each gate electrode of the transistors 21 to 24 is connected to the scanning line (Gaj). The capacitor 27 performs a role in storing the voltage between a gate and a source of the transistor 25. Note that it is not always necessary to form the capacitor element 27 for cases in which the gate capacitances of the transistors 25 and 26 are large, for cases in which the parasitic capacitance of a node is high, and the like.

A low electric potential signal is sent to the scanning line (Gaj) in the pixel 11 shown in FIG. 2A during write-in of a video signal data current, and the transistors 21 to 23 turn on, while the transistor 24 turns off. A parallel connection relationship between the transistors 25 and 26 is formed at this point, based on the current pathway. On the other hand, a high electric potential signal is sent to the scanning line (Gaj) when electric current flows in the light emitting element 28, and the transistors 21 to 23 turn off, while the transistor 24 turns on. A series connection relationship is formed between the transistors 25 and 26 at this point, based on the current pathway.

Switching of the connection relationship between the transistors 25 and 26 of the driver element 15 is controlled by only the scanning line (Gaj) in the example of FIG. 2A. Further, the first switch is structured by only two transistors, and the second switch is structured by only one transistor, a structure having the least number of transistors. The number of scanning lines and the number of transistors are thus suppressed in the example of FIG. 2A, and therefore this structure is applicable to cases in which securing a large aperture ratio or reducing the proportion of structural defects generated is important.

An example that differs from that of FIG. 2A is explained next using FIG. 2B.

Figure 2B:
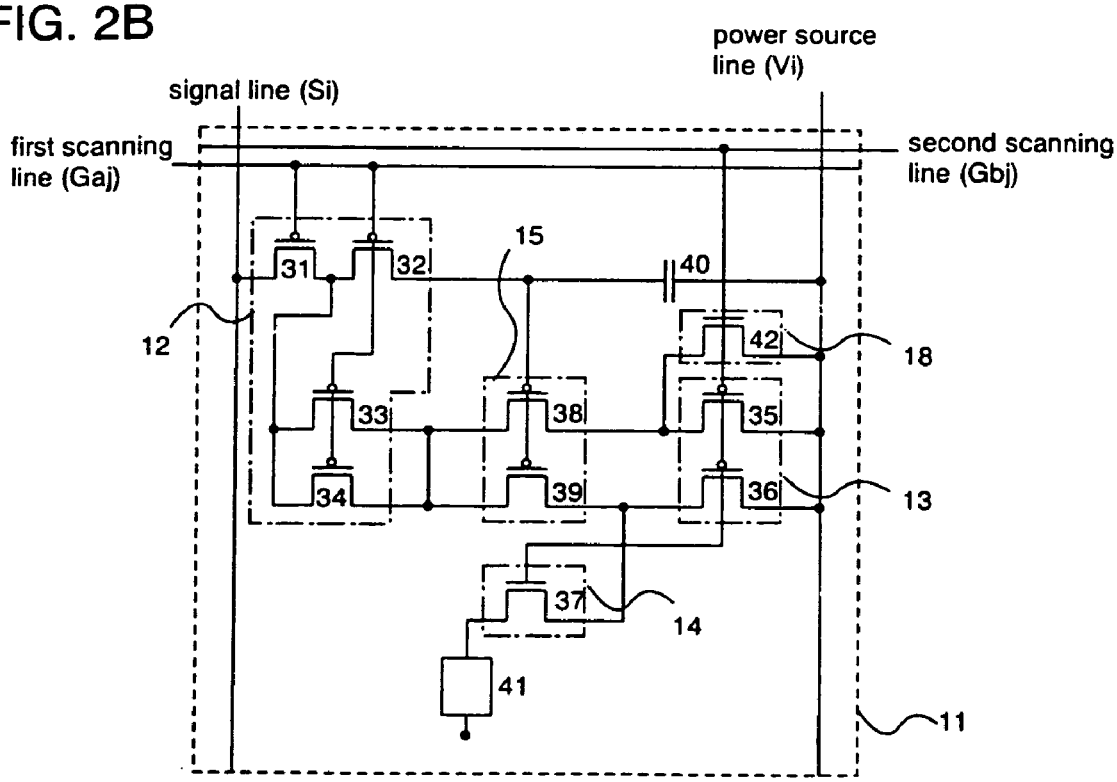

The pixel 11 disposed in the j-th row and the i-th column is shown in FIG. 2B. The pixel 11 has a signal line (Si), a power source line (Vi), a first scanning line (Gaj), a second scanning line (Gbj), transistors 31 to 39, and 42, a capacitor element 40, and a light emitting element 41. The pixel 11 shown in FIG. 2B is the pixel 11 shown in FIG. 1B, but shown specifically by transistors. The transistors 31 to 34, which are p-channel, correspond to the first switch 12. The transistors 35 and 36 which are p-channel, correspond to the second switch 13, and the transistor 37, which is n-channel, corresponds to the third switch 14. The transistors 38 and 39, which are p-channel, correspond to the driver element 15. The transistor 42, which is n-channel, corresponds to the fourth switch 18.

Each gate electrode of the transistors 31 to 34 is connected to the first scanning line (Gaj). Each gate electrode of the transistors 35 to 37, and 42 is connected to the second scanning line (Gbj). The capacitor element 40 performs a role in storing the voltage between a gate and a source of the transistor 38. Note that it is not always necessary to form the capacitor element 40 for cases in which the gate capacitances of the transistors 38 and 39 are large, for cases in which the parasitic capacitance of a node is high, and the like.

A low electric potential signal is sent to the first scanning line (Gaj) and the second scanning line (Gbj) in the pixel 11 shown in FIG. 2B during write-in of a video signal data current, and the transistors 31 to 36 turn on, while the transistors 37 and 42 turn off. A parallel connection relationship between the transistors 38 and 39 is formed at this point, based on the current pathway. On the other hand, a high electric potential signal is sent to the scanning line (Gaj) when electric current flows in the light emitting element 41, and the transistors 31 to 36 turn off, while the transistors 37 and 42 turn on. A series connection relationship is formed between the transistors 38 and 39 at this point, based on the current pathway.

Switching of the connection relationship between the transistors 38 and 39 of the driver element 15 is controlled by using the first scanning line (Gaj) and the second scanning line (Gbj) with the example of FIG. 2B. However, the transistors controlled by the second scanning line (Gbj) are all not connected to the signal line (Si). Further, there is a characteristic that whether or not electric current flows in the light emitting element 41 to emit light can be controlled by only the electric potential of the second scanning line (Gbj), irrespective of the electric potential of the first scanning line (Gaj). The amount of time that the light emitting element 41 emits light can therefore be controlled arbitrarily by sending signals independent of the first scanning line (Gaj) to the second scanning line (Gbj) in the time other than the time of data current write-in.

This is extremely important for cases in which intermediate gray scale expression is performed by a time gray scale method. This is because sufficient multi-gray scale display is difficult without a means for stopping light emission during a column scanning period for cases in which a time gray scale method is applied to an AM-OLED having a polysilicon TFT driver circuit. Further, this is also useful for cases in which intermediate gray scale expression is performed using an analog video signal data current, in application to impulse light emission and the like in order to stop dynamic distortions peculiar to hold type displays (refer to Kurita, T., Proc. AM-LCD 2000, pp. 1-4 (2000), for example, regarding dynamic distortions peculiar to hold type displays).

Further, the example of FIG. 2B is one in which storage of the video signal data current is performed very accurately. With the example of FIG. 2A, the transistor 25 is directly connected to the power source line (Vi) during data current write-in, while the transistor 26 is connected through the transistor 23. An inaccuracy equal to the amount of voltage drop over the transistor 23 therefore occurs during write-in of the data current. On the other hand, the transistor 38 is connected to the power source line (Vi) through the transistor 35, and the transistor 39 is connected to the power source line (Vi) through the transistor 36 with the example of FIG. 2B. If the voltage drops caused by the transistor 35 and the transistor 36 respectively are of the same order, then storage of the video signal data current can be performed very accurately.

A third example is explained next using FIG. 3A.

Figure 3A:
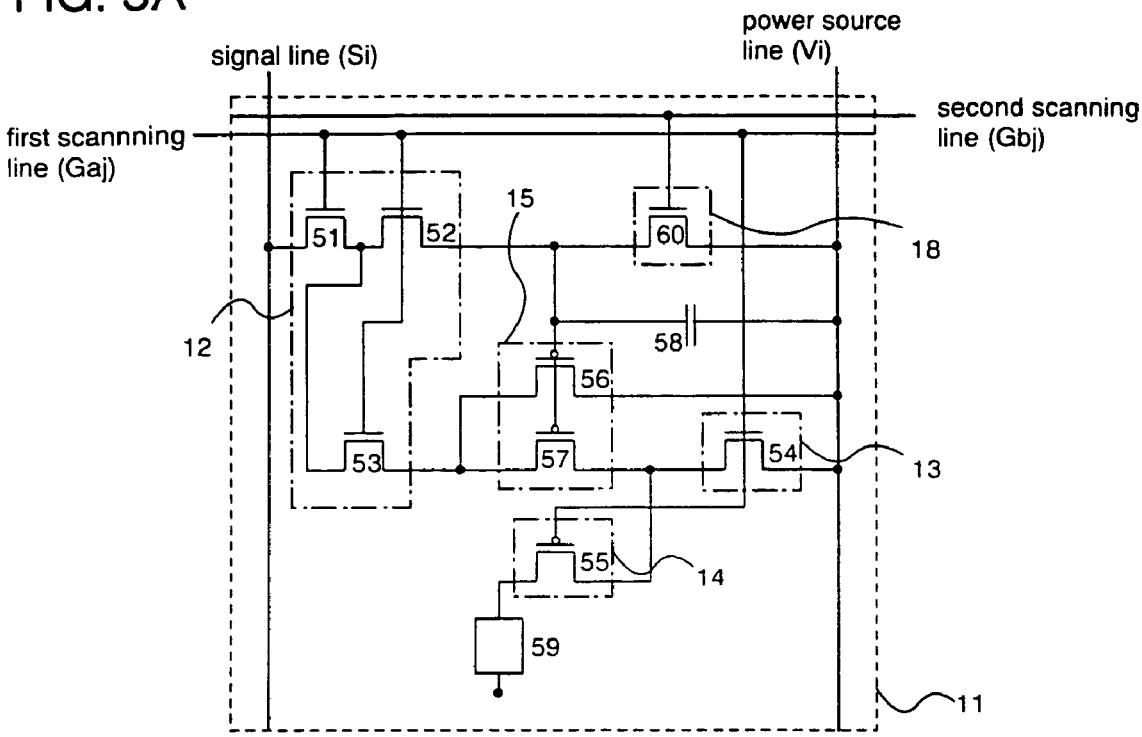
FIGS. 3A and 3B are diagrams showing a pixel of a display device and a light emitting device of the present invention.

The pixel 11 disposed in the j-th row and the i-th column is shown in FIG. 3A. The pixel 11 has a signal line (Si), a power source line (Vi), a first scanning line (Gaj), a second scanning line (Gbj), transistors 51 to 57, and 60, a capacitor element 58, and a light emitting element 59. The pixel 11 shown in FIG. 3A is the pixel 11 shown in FIG. 1B, but shown specifically by transistors. The transistors 51 to 53, which are n-channel, correspond to the first switch 12. The transistor 54, which is n-channel, corresponds to the second switch 13, and the transistor 55, which is p-channel, corresponds to the third switch 14. The transistors 56 and 57, which are p-channel, correspond to the driver element 15. The transistor 60, which is n-channel, corresponds to the fourth switch 18.

Each gate electrode of the transistors 51 to 55 is connected to the first scanning line (Gaj). A gate electrode of the transistor 60 is connected to the second scanning line (Gbj). The capacitor element 58 performs a role in storing the voltage between a gate and a source of the transistor 56. Note that it is not always necessary to form the capacitor element 58 for cases in which the gate capacitances of the transistors 56 and 57 are large, for cases in which the parasitic capacitance of a node is high, and the like.

A high electric potential signal is sent to the first scanning line (Gaj) in the pixel 11 shown in FIG. 3A during write-in of a video signal data current, and the transistors 51 to 54 turn on, while the transistor 55 turns off. A parallel connection relationship between the transistors 56 and 57 is formed at this point, based on the current pathway. On the other hand, a low electric potential signal is sent to the scanning line (Gaj) when electric current flows in the light emitting element 59, and the transistors 51 to 54 turn off, while the transistor 55 turns on. A series connection relationship is formed between the transistors 56 and 57 at this point, based on the current pathway.

Note that a low electric potential signal is sent to the second scanning line (Gbj) during the aforementioned period, turning the transistor 60 off.

The amount of time that the light emitting element 59 emits light can be arbitrarily controlled by the signal sent to the second scanning line (Gbj), similar to the case of the example of FIG. 2B. Namely, if a high electric potential signal is sent to the second scanning line (Gbj) during light emission by the light emitting element 59, and the transistor 60 turns on, the transistor 56 then turns off and the light emitting element 59 stops emitting light. However, once the light emitting element 59 is made to stop emitting light, the light emitting element 59 will then not emit light unless a video signal data current is again written in, which differs from the example of FIG. 2B.

The features of the fact that the amount of time that the light emitting element 59 emits light can be arbitrarily controlled in the pixel shown by FIG. 3A is similar to the example of FIG. 2B. That is, it becomes possible to perform intermediate gray scale expression by a time gray scale method. Further, this is also useful for cases in which intermediate gray scale expression is performed using an analog video signal data current, in application to impulse light emission and the like in order to stop dynamic distortions peculiar to hold type displays.

The transistors 51 to 54 of the first switch 12 and the second switch 13, and the transistor 60 of the fourth switch 18 are n-channel, and the transistor 55 of the third switch 14 is p-channel in the pixel 11 shown by FIG. 3A. This differs from the examples of FIGS. 2A and 2B. This is only an example, however, and the channel types of the transistors in the switches are not particularly limited to these types.

A fourth example is explained next using FIG. 3B.

Figure 3B:
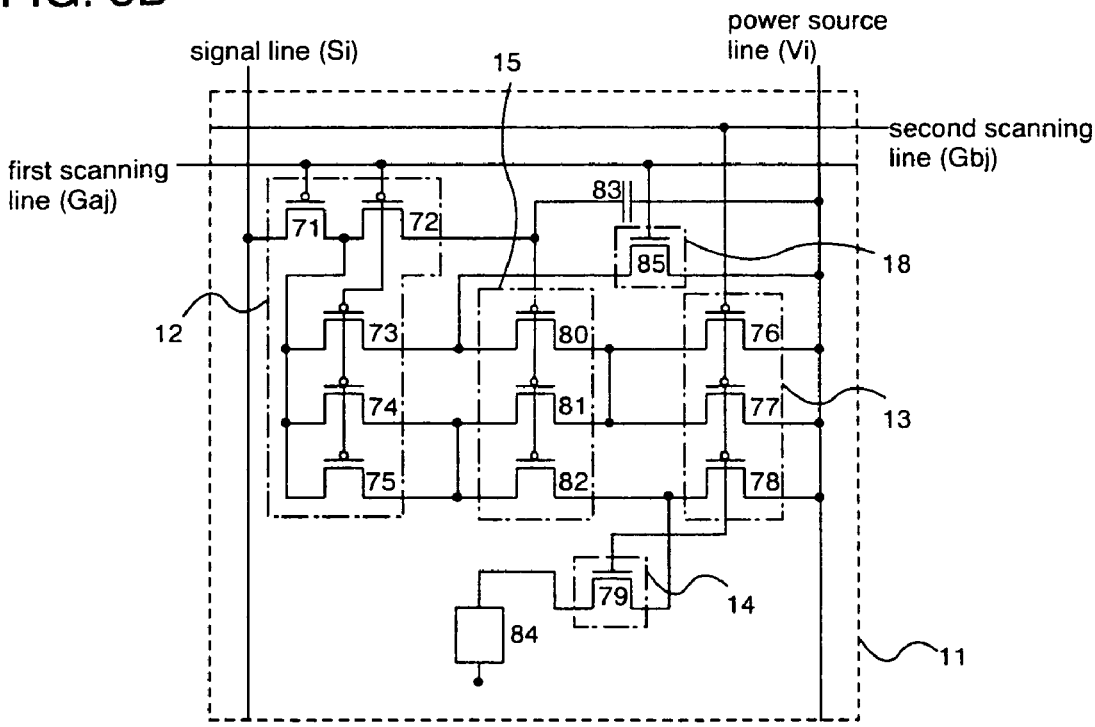

The pixel 11 disposed in the j-th row and the i-th column is shown in FIG. 3B. The pixel 11 has a signal line (Si), a power source line (Vi), a first scanning line (Gaj), a second scanning line (Gbj), transistors 71 to 82, and 85, a capacitor element 83, and a light emitting element 84. The pixel 11 shown in FIG. 3B is the pixel 11 shown in FIG. 1B, but shown specifically by transistors. The transistors 71 to 75, which are p-channel, correspond to the first switch 12. The transistors 76 to 78, which are p-channel, correspond to the second switch 13, and the transistor 79, which is n-channel, corresponds to the third switch 14. The transistors 80 to 82, which are p-channel, correspond to the driver element 15. The transistor 85, which is n-channel, corresponds to the fourth switch 18.

Each gate electrode of the transistors 71 to 75, and 85 is connected to the first scanning line (Gaj). A gate electrode of the transistors 76 to 79 is connected to the second scanning line (Gbj). The capacitor element 83 performs a role in storing the voltage between a gate and a source of the transistor 80. Note that it is not always necessary to form the capacitor element 83 for cases in which the gate capacitances of the transistors 80 to 82 are large, for cases in which the parasitic capacitance of a node is high, and the like.

A low electric potential signal is sent to the first scanning line (Gaj) and the second scanning line (Gbj) in the pixel 11 shown in FIG. 3B during write-in of a video signal data current, and the transistors 71 to 78 turn on, while the transistors 79 and 85 turn off. A parallel connection relationship between the transistors 80 to 82 is formed at this point, based on the current pathway. On the other hand, a high electric potential signal is sent to the scanning line (Gaj) when electric current flows in the light emitting element 84, and the transistors 71 to 78 turn off, while the transistors 79 and 85 turn on. A series connection relationship is formed between the transistors 80 to 82 at this point, based on the current pathway.

Switching of the transistors 80 to 82 of the driver element 15 is controlled by using the first scanning line (Gaj) and the second scanning line (Gbj) in the example of FIG. 3B. However, the transistors controlled by the second scanning line (Gbj) are not connected to the signal line (Si). Further, there is a characteristic that whether or not electric current is made to flow in the light emitting element 84 to emit light does not have relation to the electric potential of the first scanning line (Gaj), and can be controlled by only the electric potential of the second scanning line (Gbj). The amount of time during which the light emitting element 84 emits light can therefore be arbitrarily controlled by sending signals independent of the first scanning line (Gaj) to the second scanning line (Gbj) in the time other than the time of data current write-in. This is similar to the example of FIG. 2B.

The following advantages therefore can be obtained since the amount of time that the light emitting element 84 emits light can also be arbitrarily controlled in the pixel 11 shown in FIG. 3B. That is, first, it becomes possible to perform intermediate gray scale expression by using a time gray scale method. Further, this is also useful for cases in which intermediate gray scale expression is performed using an analog video signal data current, in application to impulse light emission and the like in order to stop dynamic distortions peculiar to hold type displays.

A fifth example is explained next using FIG. 4A.

Figure 4A:
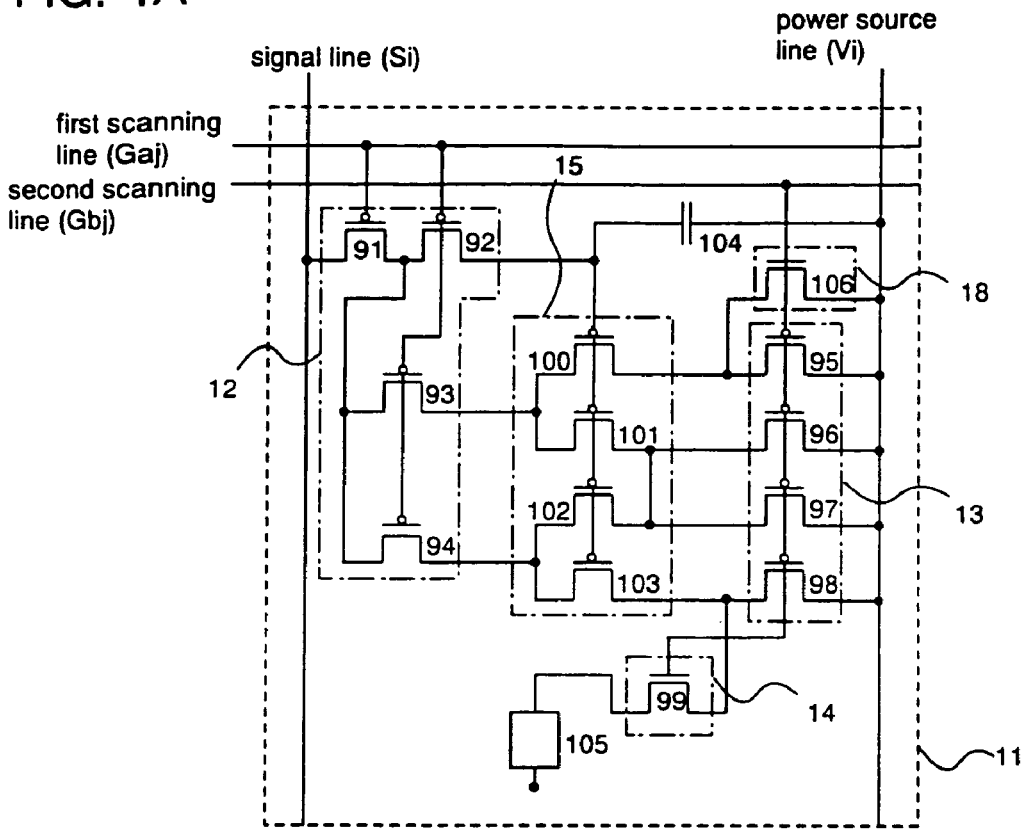
FIGS. 4A and 4B are diagrams showing a pixel of a display device and a light emitting device of the present invention.

The pixel 11 disposed in the j-th row and the i-th column is shown in FIG. 4A. The pixel 11 has a signal line (Si), a power source line (Vi), a first scanning line (Gaj), a second scanning line (Gbj), transistors 91 to 103, and 106, a capacitor element 104, and a light emitting element 105. The pixel 11 shown in FIG. 4A is the pixel 11 shown in FIG. 1B, but shown specifically by transistors. The transistors 91 to 94, which are p-channel, correspond to the first switch 12. The transistors 95 to 98 which are p-channel, correspond to the second switch 13, and the transistor 99, which is n-channel, corresponds to the third switch 14. The transistors 100 to 103, which are p-channel, correspond to the driver element 15. The transistor 106, which is n-channel, corresponds to the fourth switch 18.

Each gate electrode of the transistors 91 to 94 is connected to the first scanning line (Gaj). A gate electrode of the transistors 95 to 99 and 106 is connected to the second scanning line (Gbj). The capacitor element 104 performs a role in storing the voltage between a gate and a source of the transistor 100. Note that it is not always necessary to form the capacitor element 104 for cases in which the gate capacitances of the transistors 100 to 103 are large, for cases in which the parasitic capacitance of a node is high, and the like.

A low electric potential signal is sent to the first scanning line (Gaj) and the second scanning line (Gbj) in the pixel 11 shown in FIG. 4A during write-in of a video signal data current, and the transistors 91 to 98 turn on, while the transistors 99 and 106 turn off. A parallel connection relationship between the transistors 100 to 103 is formed at this point, based on the current pathway. On the other hand, a high electric potential signal is sent to the scanning line (Gaj) when electric current flows in the light emitting element 105, and the transistors 91 to 98 turn off, while the transistors 99 and 106 turn on. A series connection relationship is formed between the transistors 100 to 103 at this point, based on the current pathway.

Switching of the transistors 100 to 103 of the driver element 15 is controlled by using the first scanning line (Gaj) and the second scanning line (Gbj) in the example of FIG. 4A. However, the transistors controlled by the second scanning line (Gbj) are not connected to the signal line (Si). Further, there is a characteristic that whether or not electric current is made to flow in the light emitting element 105 to emit light does not have relation to the electric potential of the first scanning line (Gaj), and can be controlled by only the electric potential of the second scanning line (Gbj). The amount of time during which the light emitting element 105 emits light can therefore be controlled by sending signals independent of the first scanning line (Gaj) to the second scanning line (Gbj) in the time other than the time of data current write-in. This is similar to the example of FIG. 2B.

The following advantages can be obtained since the amount of time that the light emitting element 105 emits light can also be controlled in the pixel shown by FIG. 4A. That is, first, it becomes possible to perform intermediate gray scale expression by using a time gray scale method. Further, this is also useful for cases in which intermediate gray scale expression is performed using an analog video signal data current, in application to impulse light emission and the like in order to stop dynamic distortions peculiar to hold type displays.

A sixth example is explained next using FIG. 4B.

Figure 4B:
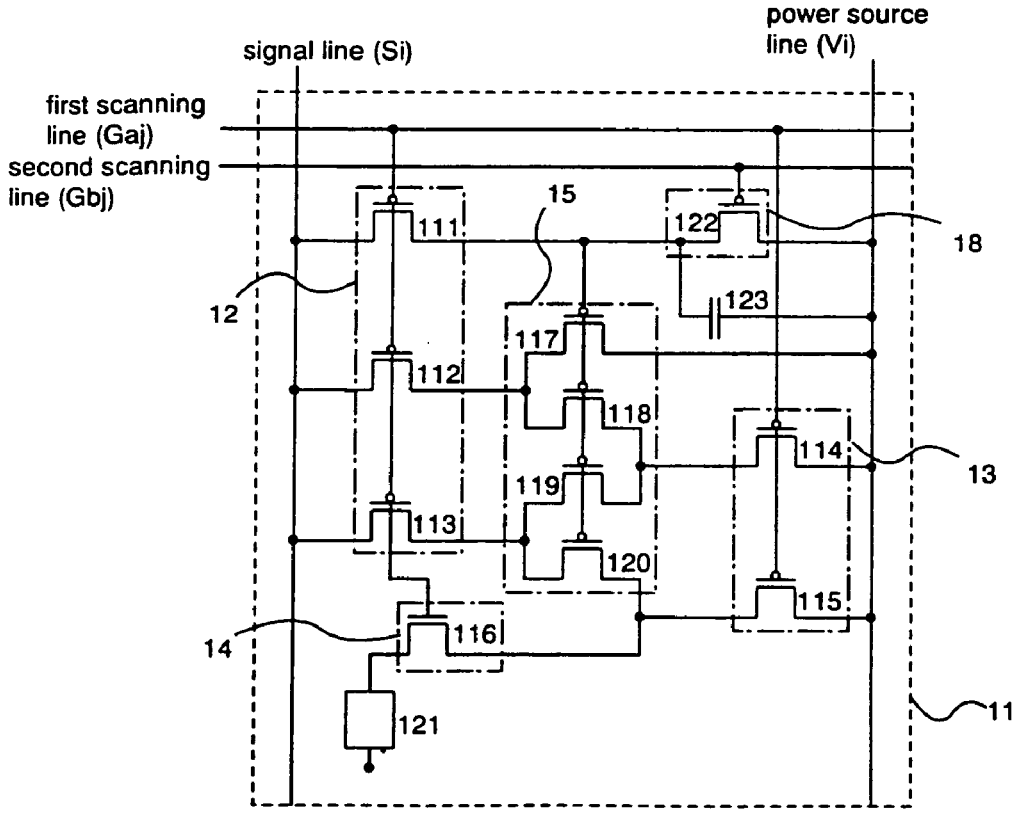

The pixel 11 disposed in the j-th row and the i-th column is shown in FIG. 4B. The pixel 11 has a signal line (Si), a power source line (Vi), a first scanning line (Gaj), a second scanning line (Gbj), transistors 111 to 120, and 122, a capacitor element 123, and a light emitting element 121. The pixel 11 shown in FIG. 4B is the pixel 11 shown in FIG. 1B, but shown specifically by transistors. The transistors 111 to 113, which are p-channel, correspond to the first switch 12. The transistors 114 and 115, which are p-channel, correspond to the second switch 13, and the transistor 116, which is n-channel, corresponds to the third switch 14. The transistors 117 to 120, which are p-channel, correspond to the driver element 15. The transistor 122, which is p-channel, corresponds to the fourth switch 18.

Each gate electrode of the transistors 111 to 116 is connected to the first scanning line (Gaj). A gate electrode of the transistor 122 is connected to the second scanning line (Gbj). The capacitor element 123 performs a role in storing the voltage between a gate and a source of the transistor 117. Note that it is not always necessary to form the capacitor element 123 for cases in which the gate capacitances of the transistors 117 to 120 are large, for cases in which the parasitic capacitance of a node is high, and the like.

A high electric potential signal is sent to the first scanning line (Gaj) in the pixel 11 shown in FIG. 4B during write-in of a video signal data current, and the transistors 111 to 115 turn on, while the transistor 116 turns off. A parallel connection relationship between the transistors 117 to 120 is formed at this point, based on the current pathway. On the other hand, a low electric potential signal is sent to the first scanning line (Gaj) when electric current flows in the light emitting element 121, and the transistors 111 to 115 turn off, while the transistor 116 turns on. A series connection relationship is formed between the transistors 117 to 120 at this point, based on the current pathway.

Note that a low electric potential signal is sent to the second scanning line (Gbj) during the aforementioned period, turning the transistor 122 off.

The amount of time that the light emitting element 121 emits light can be arbitrarily controlled by the signal sent to the second scanning line (Gbj) in the pixel 11 shown in FIG. 4B, similar to the case of the example of FIG. 2B. Namely, if a high electric potential signal is sent to the second scanning line (Gbj) during light emission by the light emitting element 121, and the transistor 122 turns on, the transistor 117 then turns off and the light emitting element 121 stops emitting light. However, once the light emitting element 121 is made to stop emitting light, the light emitting element 121 will then not emit light unless a video signal data current is again written in, which differs from the example of FIG. 2B.

The features of the fact that the amount of time that the light emitting element 59 emits light can be arbitrarily controlled in the pixel 11 shown by FIG. 4B is similar to the example of FIG. 2B. That is, it becomes possible to perform intermediate gray scale expression by a time gray scale method. Further, this is also useful for cases in which intermediate gray scale expression is performed using an analog video signal data current, in application to impulse light emission and the like in order to stop dynamic distortions peculiar to hold type displays.

Six types of the pixel 11, each having a different structure, have been explained using FIGS. 2A to 4B as examples of the pixel 11 of the display device and the light emitting device of the present invention. Note that the pixel structure of the display device and the light emitting device of the present invention is not limited to these six types.

Embodiment Mode 2

An outline of the pixel of the display device and the led of the present invention has been discussed above using FIGS. 2A to 4B. A specific example of a pixel of the display device and the light emitting device of the present invention that differs from that of Embodiment Mode 1 is explained in Embodiment Mode 2 by using FIGS. 12A to 16A. Examples are given for cases in which the number of transistors n that structure a driver element 315 is three in FIGS. 12A to 15D. Examples in which n is equal to 2 is given in FIG. 16.

A first example is explained by using FIGS. 12A to 12E.

Figure 12A:
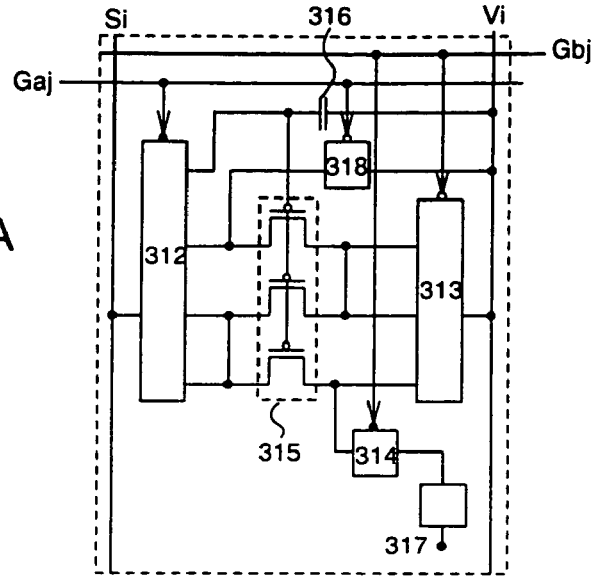
FIGS. 12A to 12E are diagrams showing a pixel of a display device and a light emitting device of the present invention.

The pixel 11 of the j-th row and the i-th column is shown in FIG. 12A. The pixel 11 has a signal line (Si), a power source line (Vi), a first scanning line (Gaj), a second scanning line (Gbj), a driver element 315, a first switch 312, a second switch 313, a third switch 314, a fourth switch 318, a capacitor element 316, and a light emitting element 317. The pixel 11 shown in FIG. 12B is an example of the pixel 11 of FIG. 12A shown specifically by transistors.

Figure 12B:
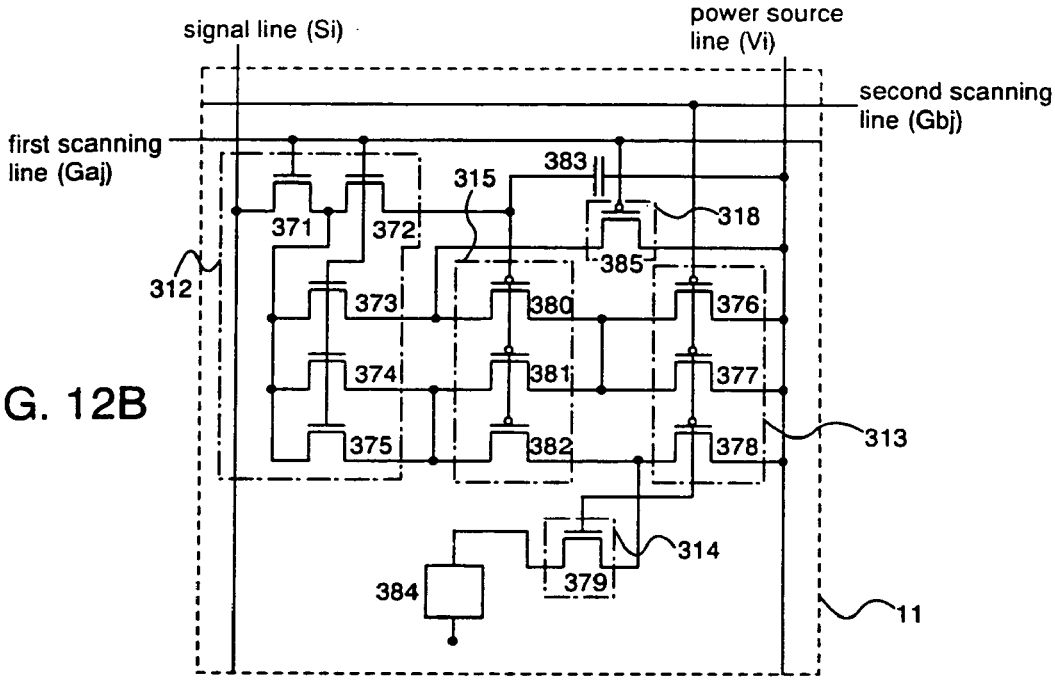
Figure 12C:
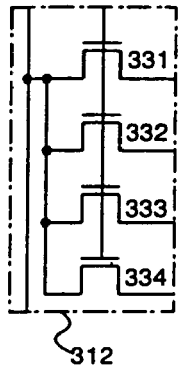
Figure 12D:
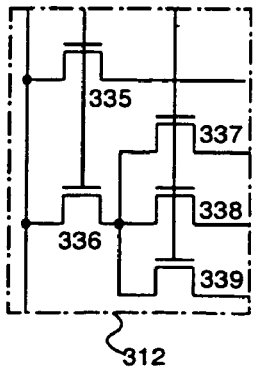
Figure 12E:
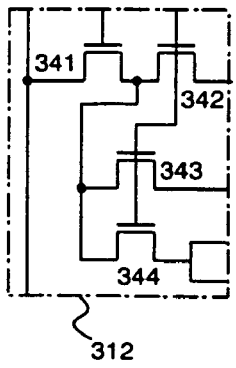

A correspondence relationship between FIG. 12A and FIG. 12B is given. N-channel transistors 371 to 375 correspond to the first switch 312. P-channel transistors 376 to 378 correspond to the second switch 313, an n-channel transistor 379 corresponds to the third switch 314, and a p-type transistor 385 corresponds to the fourth switch 318. P-type transistors 380 to 382 correspond to the driver element 315. A capacitor element 383 corresponds to the capacitor element 316, and a light emitting element 384 corresponds to the light emitting element 317.

Each gate electrode of the transistors 371 to 375 is connected to the first scanning line (Gaj). The capacitor element 383 performs a role in storing the voltage between a gate and a source of the transistor 380. Note that the capacitor element 383 may not be specifically formed for cases in which the gate capacitances of the transistors 380 to 382 are large, for cases in which the parasitic capacitance of a node is high, and the like.

A high electric potential signal is sent to the first scanning line (Gaj) and a low electric potential signal is sent to the second scanning line (Gbj) in the pixel 11 shown in FIG. 12B during write-in of a video signal data current, and the transistors 371 to 378 turn on, while the transistors 379 and 385 turn off. A parallel connection relationship between the transistors 380 to 382 is formed at this point, based on the current pathway. On the other hand, a low electric potential signal is sent to the first scanning line (Gaj) and a high electric potential signal is sent to the second scanning line (Gbj) when electric current flows in the light emitting element 384, and the transistors 371 to 378 turn off, while the transistors 379 and 385 turn on. A series connection relationship is formed between the transistors 380 and 382 at this point, based on the current pathway.

FIG. 12A conceptually includes FIG. 12B, but the two are not identical. For example, the first switch 312 may adopt a structure with transistors 331 to 334 of FIG. 12C, instead of the structure with the transistors 371 to 375 of FIG. 12B. Further, the first switch 312 may adopt a structure with transistors 335 to 339 of FIG. 12D, or a structure with transistors 341 to 344 of FIG. 12E. Note that, whichever of the structures of FIGS. 12B to 12E is specifically adopted, for the first switch 312 of FIG. 12A, they can be said to be identical in practice. Therefore block reference symbols like those of FIG. 12A are mainly used in the examples below.

Figure 13A:
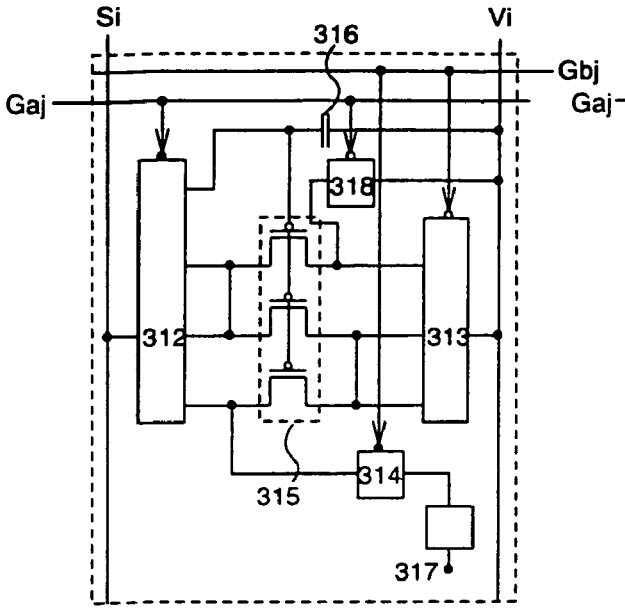
FIGS. 13A to 13D are diagrams showing a pixel of a display device and a light emitting device of the present invention.
Figure 14A:
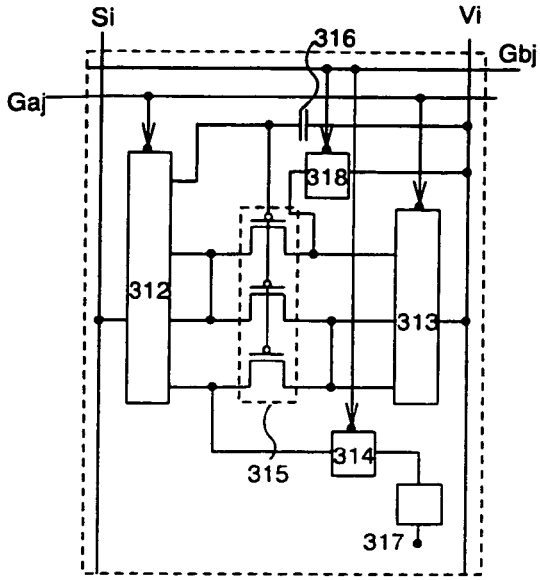
FIGS. 14A to 14C are diagrams showing a pixel of a display device and a light emitting device of the present invention.
Figure 14B:
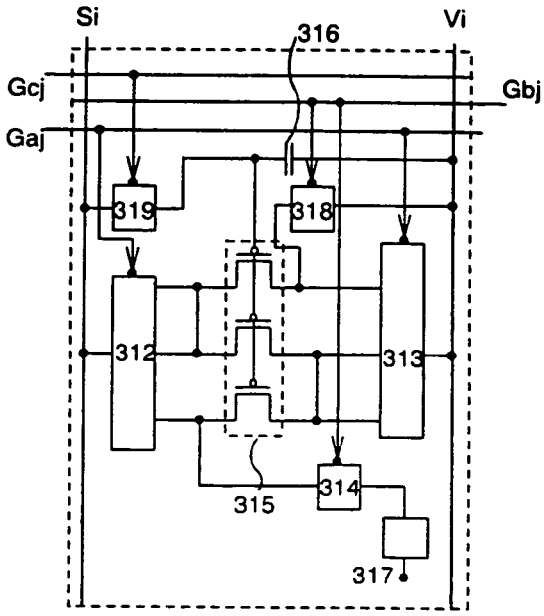
Figure 14C:
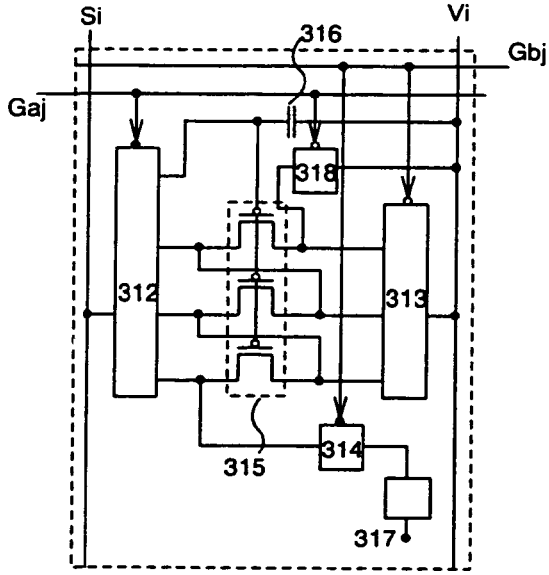

A second example is FIGS. 13A and 14C. Except for the method of connecting the three transistors that structure the driver element 315, these are the same as FIG. 12A.

For example, signals sent to the first scanning line (Gaj) and the second scanning line (Gbj) in pixel circuits of FIGS. 13A and 14C are similar to those of FIGS. 12A to 12E. A high electric potential signal is sent to the first scanning line (Gaj) and a low electric potential signal is sent to the second scanning line (Gbj) during write-in of a video signal data current, and the first switch 312 and the second switch 313 turn on, while the third switch 314 and the fourth switch 318 turn off. A low electric potential signal is sent to the first scanning line (Gaj) and a high electric potential signal is sent to the second scanning line (Gbj) when electric current flows in the light emitting element 317, and the first switch 312 and the second switch 313 turn off, while the third switch 314 and the fourth switch 318 turn on.

FIG. 13A and FIG. 14C differ from FIG. 12A in the method used for connecting the three transistors that structure the driver element 315. FIG. 13A, FIG. 14C, and FIG. 12A can be expected to each possess identical performance provided that the three transistors have source drain symmetry (all the time in terms of electrical characteristics). However, if there is no source drain symmetry (all the time in terms of electrical characteristics), then the performance of FIG. 13A, FIG. 14C, and FIG. 12A will vary slightly. In this case, there is no substitution of the source and the drain (high electric potential side terminal and low electric potential side terminal) in any of the three transistors that structure the driver element 315, both in a parallel connection and a serial connection, and FIG.

14C is the most preferred from in terms of circuit performance. On the other hand, however, FIG. 13A and FIG. 12A, which have the possibility of a slight inferiority in circuit performance, are superior to FIG. 14C in their simplicity when laying out in small pixels.

Figure 13B:
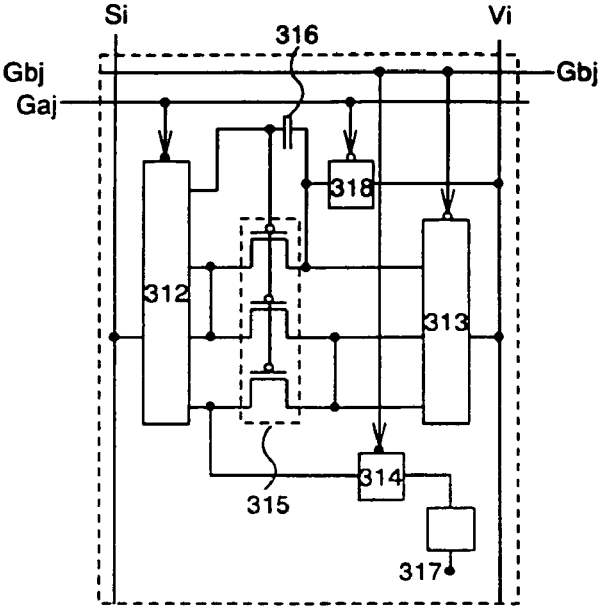

A third example shown in FIG. 13B differs from FIG. 13A only in the connection position of the capacitor element 316.

For example, signals sent to the first scanning line (Gaj) and the second scanning line (Gbj) are similar to those of FIG. 13A. A high electric potential signal is sent to the first scanning line (Gaj) and a low electric potential signal is sent to the second scanning line (Gbj) during write-in of a video signal data current, and the first switch 312 and the second switch 313 turn on, while the third switch 314 and the fourth switch 318 turn off. A low electric potential signal is sent to the first scanning line (Gaj) and a high electric potential signal is sent to the second scanning line (Gbj) when electric current flows in the light emitting element 317, and the first switch 312 and the second switch 313 turn off, while the third switch 314 and the fourth switch 318 turn on.

FIG. 13B also differs from FIG. 13A in the position at which the capacitor element 316 is connected. Firstly, the capacitor element 316 stores the voltage between the gate and the source of the transistor structuring the driver element 315. More precisely, the voltage between the gate and the source of the transistor on the side closest to the source, among the three transistors structuring the driver element 315, is stored. From this viewpoint, a circuit of FIG. 13B can be said to be more unfailing than that of FIG. 13A.

Note that the second switch 313 turns on during write-in of the video signal data current in the circuit of FIG. 13A as well, and that the third switch 314 turns on when electric current flows in the driver element 317. As a result, in FIG. 13A as well, the voltage between the gate and the source of the transistors that structure the driver element 315 during write-in of the video signal data current is recreated when electric current flows in the light emitting element 317. That is, the circuit of FIG. 13A and the circuit of FIG. 13B are the same in that they store the gate-source voltage of the transistors which structure the driver element 315.

From the viewpoint of simplicity in the case of laying out in small pixels, FIG. 13A is generally superior to FIG. 13B.

A fourth example is FIG. 13C, FIG. 13D, FIG. 14A, and FIG. 14B. The method for controlling on/off of the first switch, the second switch, the third switch, and the fourth switch differs from that of FIG. 13A.

Figure 13C:
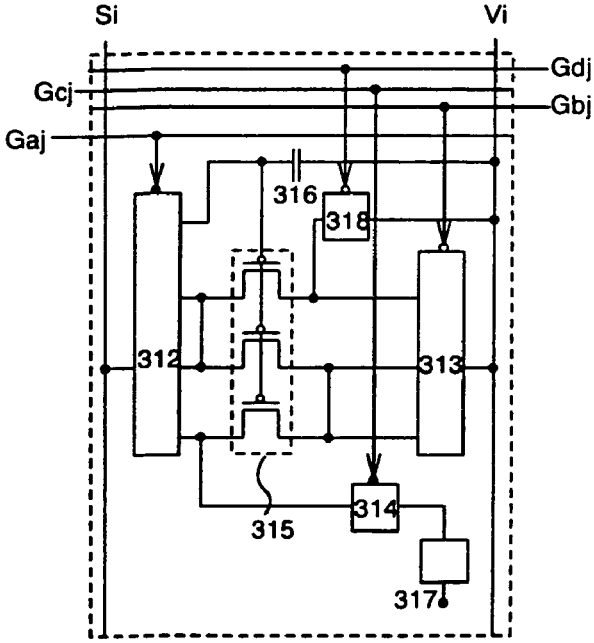

First, the circuit of FIG. 13C uses four scanning lines, a first scanning line (Gaj), a second scanning line (Gbj), a third scanning line (Gcj), and a fourth scanning line (Gdj), in controlling on/off of the first switch, the second switch, the third switch, and the fourth switch.

A high electric potential signal is sent to the first scanning line (Gaj) and the fourth scanning line (Gdj) and a low electric potential signal is sent to the second scanning line (Gbj) and the third scanning line (Gcj) during write-in of a video signal data current, and the first switch 312 and the second switch 313 turn on, while the third switch 314 and the fourth switch 318 turn off. A low electric potential signal is sent to the first scanning line (Gaj) and the fourth scanning line (Gdj) and a high electric potential signal is sent to the second scanning line (Gbj) and the third scanning line (Gcj) when electric current flows in the light emitting element 317, and the first switch 312 and the second switch 313 turn off, while the third switch 314 and the fourth switch 318 turn on.

The first scanning line (Gaj) and the fourth scanning line (Gdj) are assembled into one line, and the second scanning line (Gbj) and the third scanning line (Gcj) are assembled into one line in the circuit of FIG. 13A, but each is a separate scanning line with the circuit of FIG. 13C. This is effective in attaining stable scanning operations. Conversely, the number of scanning lines increases and therefore it is difficult to perform layout in small pixels.

Figure 13D:
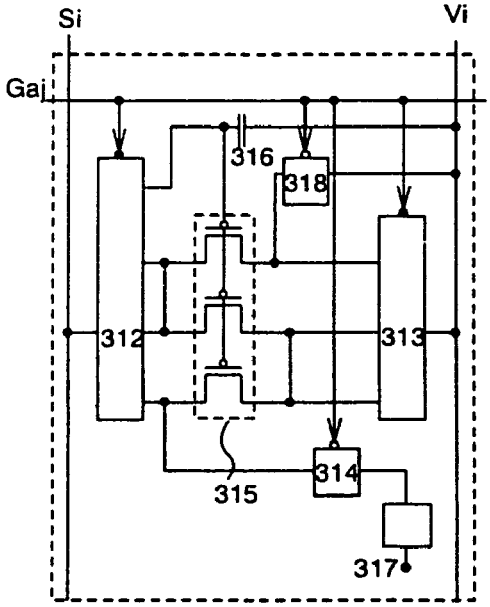

The circuit of FIG. 13D simultaneously controls on/off of the first switch, the second switch, the third switch, and the fourth switch by using only the first scanning line (Gaj).

A high electric potential signal is sent to the first scanning line (Gaj) during write-in of a video signal data current, and the first switch 312 and the second switch 313 turn on, while the third switch 314 and the fourth switch 318 turn off. A low electric potential signal is sent to the first scanning line (Gaj) when electric current flows in the light emitting element 317, and the first switch 312 and the second switch 313 turn off, while the third switch 314 and the fourth switch 318 turn on.

While two scanning lines, the first scanning line (Gaj) and the second scanning line (Gbj) are used, in the circuit of FIG. 13A, the two are assembled into one scanning line in the circuit of FIG. 13D. There is an effect in that layout becomes easier in small pixels by the amount that the number of scanning lines is reduced. However, there are weaknesses with only one scanning line. For example, the amount of time that electric current flows in the light emitting element 317 cannot be controlled by devising a scheme for the scanning timing of two scanning lines.

The circuit of FIG. 14A is the same as the circuit of FIG. 13A in that control for turning the first switch, the second switch, the third switch, and the fourth switch on and off is simultaneously performed by the first scanning line (Gaj) and the second scanning line (Gbj). However, the combination of switches for controlling whether each scanning line turns on or off differs from the circuit of FIG. 13A. The first scanning line (Gaj) controls the first switch and the second switch with the circuit of FIG. 14A, while the second scanning line (Gbj) controls the third switch and the fourth switch.

A high electric potential signal is sent to the first scanning line (Gaj) and a low electric potential signal is sent to the second scanning line (Gbj) during write-in of a video signal data current, and the first switch 312 and the second switch 313 turn on, while the third switch 314 and the fourth switch 318 turn off. A low electric potential signal is sent to the first scanning line (Gaj) and a high electric potential signal is sent to the second scanning line (Gbj) when electric current flows in the light emitting element 317, and the first switch 312 and the second switch 313 turn off, while the third switch 314 and the fourth switch 318 turn on.

The circuit of FIG. 14A is one in which the switch that turns on during write-in of a video signal data current, and the switch that turns on when electric current flows in the light emitting element 317 are controlled to turn on and off by different scanning lines. This circuit is therefore superior from the standpoint of stable operation. However, while the circuit of FIG. 13A uses p-channel switches in the second switch 313 and the fourth switch 318, n-channel switches are used by the circuit of FIG. 14A. It is therefore necessary that high electric potential signals of the first scanning line (Gaj) and the second scanning line (Gbj) in the circuit of FIG. 14A be higher than those used for the circuit of FIG. 13A.

The circuit of FIG. 14B divides the first switch 312 of FIG. 14A. That is, a portion for storing and releasing the gate voltage of the transistor that structures the driver element within the first switch 312 of FIG. 14A is divided out as a switch 319. The switch 319 can therefore be controlled to turn on and off independently from the first switch 312 by using the third scanning line (Gcj).

A high electric potential signal is sent to the first scanning line (Gaj) and the third scanning line (Gcj) and a low electric potential signal is sent to the second scanning line (Gbj) during write-in of a video signal data current, and the first switch 312 and the second switches 313 and 319 turn on, while the third switch 314 and the fourth switch 318 turn off. A low electric potential signal is sent to the first scanning line (Gaj) and the third scanning line (Gcj) and a high electric potential signal is sent to the second scanning line (Gbj) when electric current flows in the light emitting element 317, and the first switch 312 and the second switches 313 and 319 turn off, while the third switch 314 and the fourth switch 318 turn on.

The switch 319 can be turned off earlier than the first switch 312 with the circuit of FIG. 14B when writing in the video signal data current. It is therefore possible to stabilize operation. On the other hand, the number of scanning lines is increased, and therefore layout in small pixels becomes difficult.

Figure 15A:
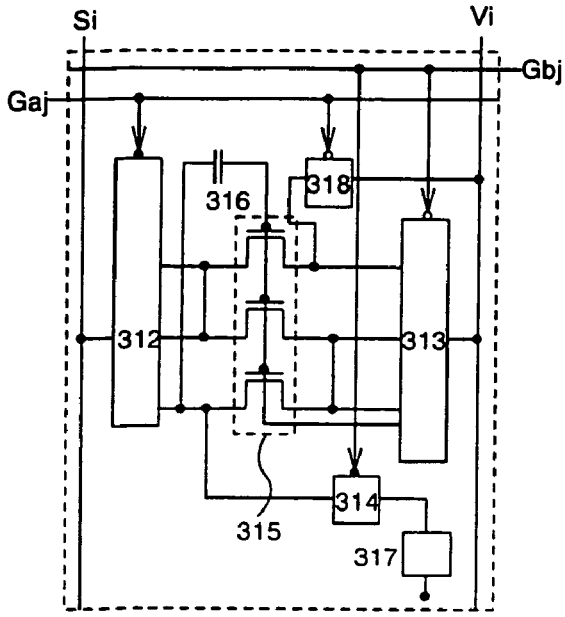
FIGS. 15A to 15D are diagrams showing a pixel of a display device and a light emitting device of the present invention.

The three transistors that structure the driver element in FIG. 15A are n-channel in FIG. 15A which corresponds to a fifth example. This point differs from FIG. 13A.

Signals sent to the first scanning line (Gaj) and the second scanning line (Gbj) are similar to those of FIG. 13A. A high electric potential signal is sent to the first scanning line (Gaj) and a low electric potential signal is sent to the second scanning line (Gbj) during write-in of a video signal data current, and the first switch 312 and the second switch 313 turn on, while the third switch 314 and the fourth switch 318 turn off. A low electric potential signal is sent to the first scanning line (Gaj) and a high electric potential signal is sent to the second scanning line (Gbj) when electric current flows in the light emitting element 317, and the first switch 312 and the second switch 313 turn off, while the third switch 314 and the fourth switch 318 turn on.

FIG. 15A also differs from FIG. 13A in the position at which the capacitor element 316 is connected. Firstly, the capacitor element 316 stores the voltage between the gate and the source of the transistor structuring the driver element 315. More precisely, the voltage between the gate and the source of the transistor on the side closest to the source, among the three transistors structuring the driver element 315, is stored. While the three transistors that structure the driver element are p-channel in FIG. 13A, the three transistors are n-channel in FIG. 15A. The position at which the capacitor element 316 is connected therefore differs with that of FIG. 13A.

The three transistors that structure the driver element in FIG. 15A are n-channel, and therefore FIG. 15A is more effective than FIG. 13A for cases in which the ideal transistor type is n-channel rather than p-channel due to manufacturing processes. From the standpoint of simplicity in performing laying out in small pixels, FIG. 13A is generally superior to FIG. 15A.

Figure 15B:
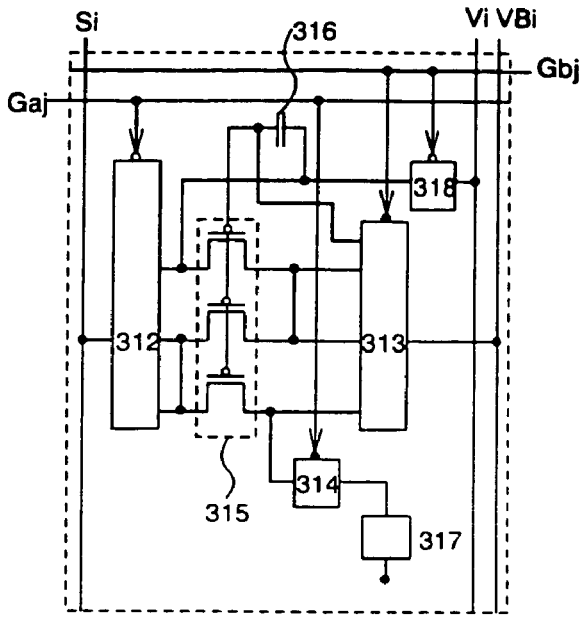
Figure 15C:
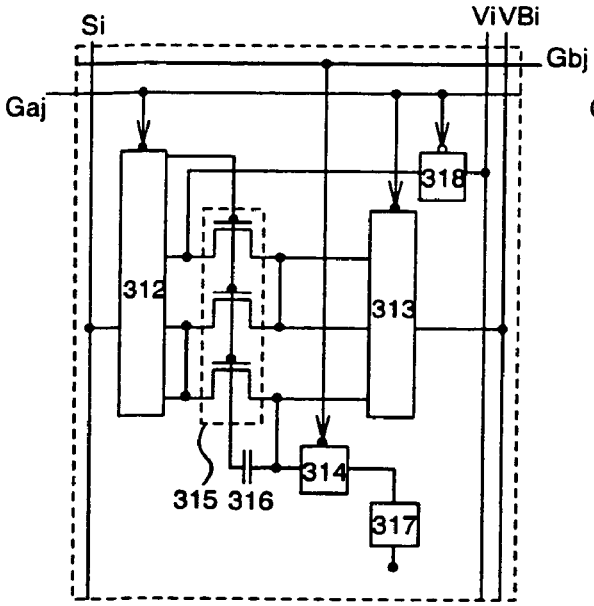

A sixth example is FIG. 15B and FIG. 15C. The direction toward which electric current flows in the driver element of FIGS. 15B and 15C during write-in of a video signal data current becomes opposite to that of the examples shown up through this point. In the circuits of FIGS. 12A to 14C, the first switch 312 side is low electric potential, and the second switch 313 side is high electric potential during write-in of the video signal data current. In the circuits of FIGS. 15B and 15C, however, the first switch 312 side is high electric potential, and the second switch 313 side is low electric potential during write-in of the video signal data current. The power source line (Vi) is a high electric potential power source line, and a power source line (Vbi) is a low electric potential power source line.

Signals sent to the scanning lines in a pixel circuit of FIG. 15B are explained. A low electric potential signal is sent to the first scanning line (Gaj) and a high electric potential signal is sent to the second scanning line (Gbj) during write-in of a video signal data current, and the first switch 312 and the second switch 313 turn on, while the third switch 314 and the fourth switch 318 turn off. A high electric potential signal is sent to the first scanning line (Gaj) and a low electric potential signal is sent to the second scanning line (Gbj) when electric current flows in the light emitting element 317, and the first switch 312 and the second switch 313 turn off, while the third switch 314 and the fourth switch 318 turn on.

Signals sent to the scanning lines in a pixel circuit of FIG. 15C are also explained. A high electric potential signal is sent to the first scanning line (Gaj) and a low electric potential signal is sent to the second scanning line (Gbj) during write-in of a video signal data current, and the first switch 312 and the second switch 313 turn on, while the third switch 314 and the fourth switch 318 turn off. A low electric potential signal is sent to the first scanning line (Gaj) and a high electric potential signal is sent to the second scanning line (Gbj) when electric current flows in the light emitting element 317, and the first switch 312 and the second switch 313 turn off, while the third switch 314 and the fourth switch 318 turn on.

Figure 15D:
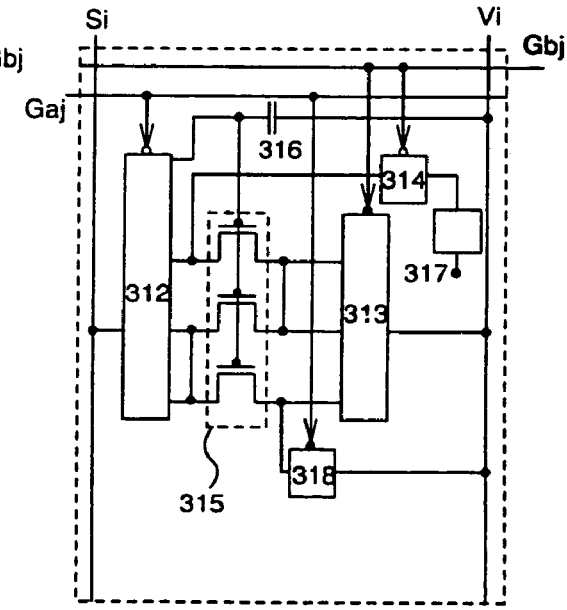

A seventh example is FIG. 15D. The direction toward which electric current flows in the circuit of FIG. 15D is opposite to that of the examples shown up through this point. In the circuits of FIGS. 12A to 14C, the third switch 314 side is low electric potential, and the fourth switch 318 side is high electric potential during write-in of the video signal data current. In the circuit of FIG. 15D, however, the third switch 314 side is high electric potential, and the fourth switch 318 side is low electric potential during write-in of the video signal data current.

The direction toward which electric current flows in the driver element in FIG. 15D during write-in of the video signal data current is the same direction as that of FIGS. 15B and 15C, and opposite to that of FIGS. 12A to 14C.

In FIG. 15D, a low electric potential signal is sent to the first scanning line (Gaj) and a high electric potential signal is sent to the second scanning line (Gbj) during write-in of a video signal data current, and the first switch 312 and the second switch 313 turn on, while the third switch 314 and the fourth switch 318 turn off. A high electric potential signal is sent to the first scanning line (Gaj) and a low electric potential signal is sent to the second scanning line (Gbj) when electric current flows in the light emitting element 317, and the first switch 312 and the second switch 313 turn off, while the third switch 314 and the fourth switch 318 turn on.

FIG. 15D is effective in cases of circuit disposal to a cathode side of the light emitting element 317.

Specific examples of the pixel of the display device and the light emitting device of the present invention have been discussed by using FIGS. 12A to 15D for cases in which the number of transistors n that structure the driver element 315 is three. An example of a case in which n is equal to two is explained next by using FIG. 16 as an example in which the number of transistors n structuring the driver element 315 is not equal to three. Note that the first switch, the second switch, the third switch, and the fourth switch are denoted by transistors, not block reference symbols, in FIG. 16, and many variations are possible for the transistor connections, similar to FIGS. 12A to 15D.

Figure 16:
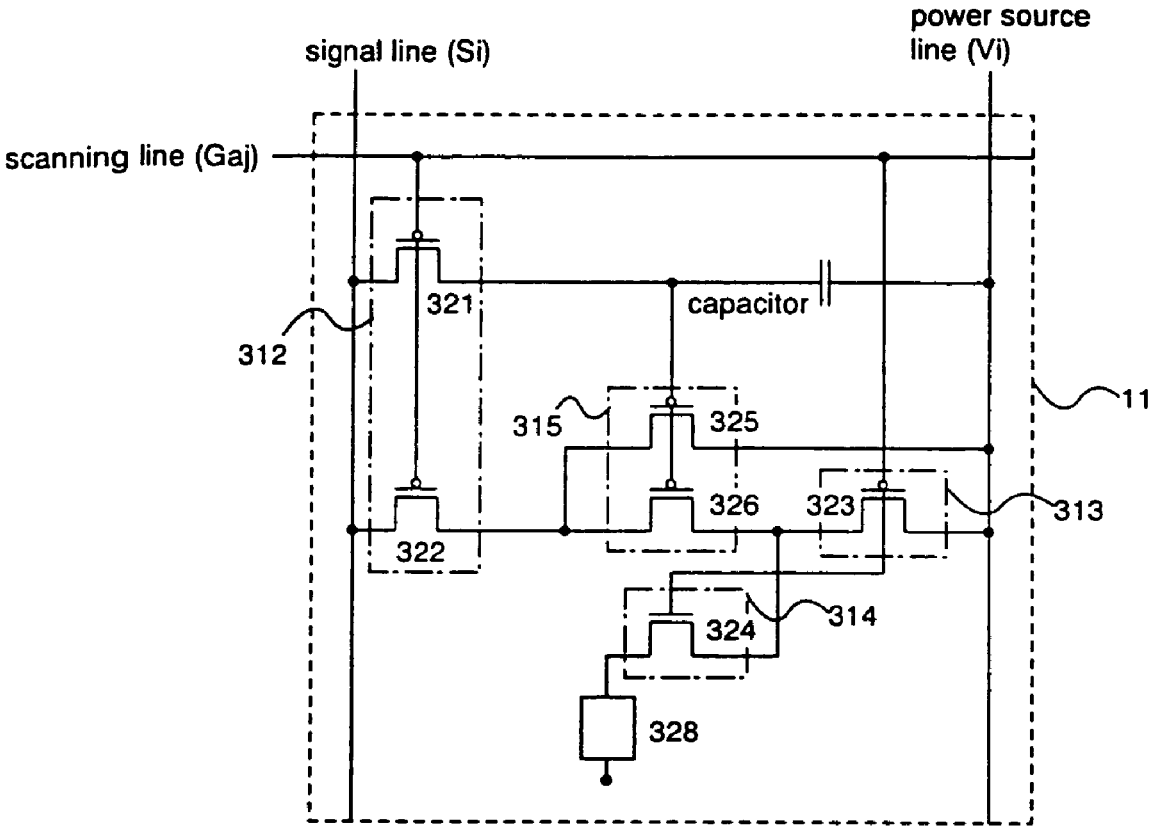
FIG. 16 is a diagram showing a pixel of a display device and a light emitting device of the present invention.

The first switch is structured by using two transistors, and the second switch is structured by using one transistor in the example of FIG. 16, which means that the minimum number of transistors are used. Switching of the connection relationship between transistors 325 and 326 of the driver element 315 is controlled by a scanning line (Gaj).

A low electric potential signal is sent to the scanning line (Gaj) during write-in of a video signal data current, and the first switch 312 which includes transistors 321 and 322, and the second switch 313 which includes a transistor 323 turn on, while the third switch 314 which includes a transistor 324 turns off. A high electric potential signal is sent to the first scanning line (Gaj) when electric current flows in the light emitting element 328, and the first switch 312 and the second switch 313 turn off, while the third switch 314 turns on.

The number of scanning lines and the number of transistors are kept small in the example of FIG. 16, and therefore FIG. 16 is suitable for cases in which importance is placed on securing a large aperture ratio or reducing the proportion of structural defects generated.

Examples of the pixel 11 of the display device and the light emitting device of the present invention have been explained by using FIGS. 12A to 16. However, the pixel structures of the display device and the light emitting device of the present invention are not limited to these structures.

Embodiment Mode 3

Figure 5A:
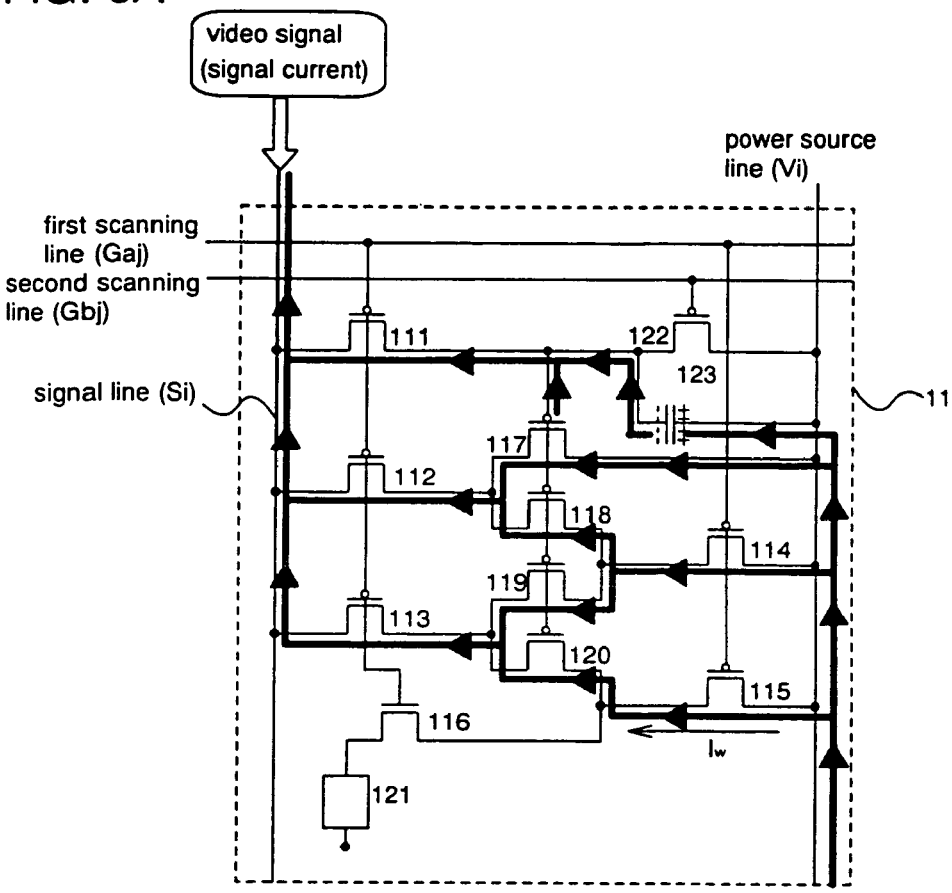
FIGS. 5A and 5B are diagrams showing current pathways in a pixel of a display device and a light emitting device of the present invention.
Figure 5B:
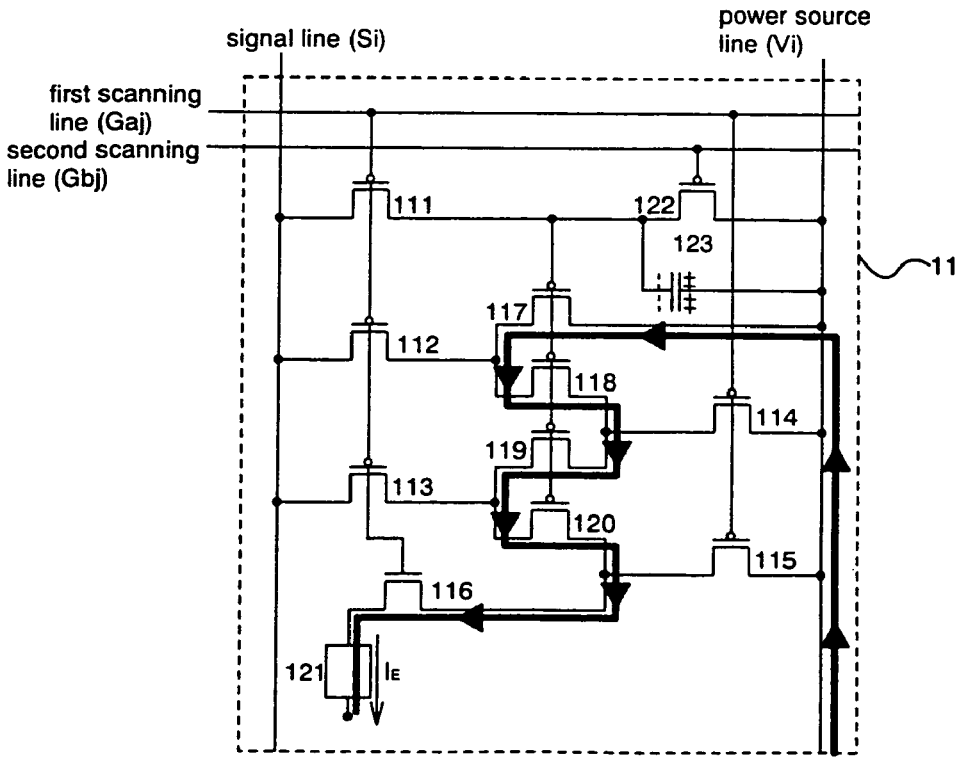

A method of driving the pixel 11 is explained in Embodiment Mode 2. The pixel shown in FIG. 4B is taken as an example, and the explanation is performed by using FIGS. 5A and 5B.

Video signal write-in operations and light emitting operations are explained first.

A first scanning line (Gaj) of a j-th row is first selected by a signal output from a scanning line driver circuit (not shown in the figures) formed in the periphery of the pixel 11. That is, a low electric potential (L level) signal is output to the first scanning line (Gaj), and gate electrodes of transistors 111 to 116 become low electric potential (L level). The transistors 111 to 115, which are p-channel, turn on at this point, while the transistor 116, which is n-channel, turns off. The video signal data current $I_W$ is then input to the pixel 11 from a signal line driver circuit (not shown in the figures) formed in the periphery of the pixel 11, through a signal line (Si) of an i-th column.

Transistors 117 to 120 are placed in a diode connected state, in which a drain and a gate are shorted in each of the transistors, when the transistors 111 to 113 turn on. That is, the pixel 11 becomes equivalent to a circuit in which four diodes are connected in parallel. The current $I_W$ flows between a power source line (Vi) and the signal line (Si) in this state (refer to FIG. 5A).

After the current $I_W$ flowing in the four diodes connected in parallel becomes steady state, the first scanning line (Gaj) is set to high electric potential (H level). The transistors 111 to 113 thus turn off, and the video signal data current $I_W$ is stored in the pixel.

The p-channel transistors 111 to 115 turn off when the first scanning line (Gaj) becomes high electric potential (H level), and the n-channel transistor 116 turns on. The connection between the transistors 117 to 120 is rearranged to a series state. A driver element supplies the fixed electric current $I_E$ to a light emitting element if the voltage conditions are set in advance so that a transistor 120 operates in the saturated region at this point.

The value of the fixed current $I_E$ is approximately 1/16 the value of the video signal data current $I_W$. This is because the driver element is structured by using four transistors in Embodiment Mode 3. In general, the current $I_E$ will become approximately $1/n^2$ of the video signal data current $I_W$ if the driver element is structured by using n transistors.

The write-in data current $I_W$ can be made into a large value in Embodiment Mode 3 if it is approximately 16 times the value of the light emitting element driver current $I_E$. Even if it is difficult to write in a very small current, on the order of the light emitting element driver current $I_E$, directly and smoothly to the pixel due to parasitic capacitance and the like, write-in of the video signal data current $I_W$ becomes possible.

Note that an analog video method may be employed in Embodiment Mode 3 as a method for expressing intermediate gray scales, and a digital video method may also be employed. The data current $I_W$ converted into an analog current is used as the video signal data current in the analog video method. For the digital video method, a unit brightness is prepared with only one data current $I_W$ taken as a standard on current. Use of a time gray scale method in which the unit brightnesses are added over time to express gray scales is convenient (digital time gray scale method). Alternatively, the digital video method can also be performed by a surface area gray scale method, in which the unit brightness is added over a surface area to express gray scales, or a method that combines the time gray scale method and the surface area gray scale method.

Further, it is necessary that the video signal data current $I_W$ be set to zero in Embodiment Mode 3, independent of which method is employed between the analog video method and the digital video method. However, the brightness of light emitted by the light emitting element is zero when the video signal data current $I_W$ is set to zero, and therefore it is not necessary to accurately write in and store $I_W$ in the pixel. A gate voltage at which the transistors 117 to 120 of the driver element turn off may therefore be output directly to the signal line (Si) in this case. That is, the video signal may be output by a voltage value, not an electric current value.

Operations for stopping light emission are explained next.

A second scanning line (Gbj) of the j-th row is selected first by a signal output from another scanning driver circuit (not shown in the figures) formed in the periphery of the pixel 11. That is, a low electric potential (L level) signal is output to the second scanning line (Gbj). A gate electrode of a p-channel transistor 122 becomes low electric potential (L level), and the transistor 122 is placed in an on state.

The source and the gate of the transistor 117 are thus shorted, and the transistor 117 turns off. Electric current supply to a light emitting element 121 is cutoff as a result, and light emission stops.

It thus becomes possible to arbitrarily control the amount of time that the light emitting element 121 emits light, without any restrictions on the amount of time to scan one row. The largest advantage of this is that intermediate gray scale expression can be performed easily by a time gray scale method. Further, there are also advantages for cases in which intermediate gray scale expression is performed using an analog video signal data current, in application to impulse light emission and the like in order to stop dynamic distortions peculiar to hold type displays.

Embodiment Mode 4

An example of a planar layout (upper surface diagram) of a pixel in the display device and the light emitting device of the present invention is presented in Embodiment Mode 4. A pixel circuit of this example is the pixel circuit shown in FIG. 3B.

Figure 6:
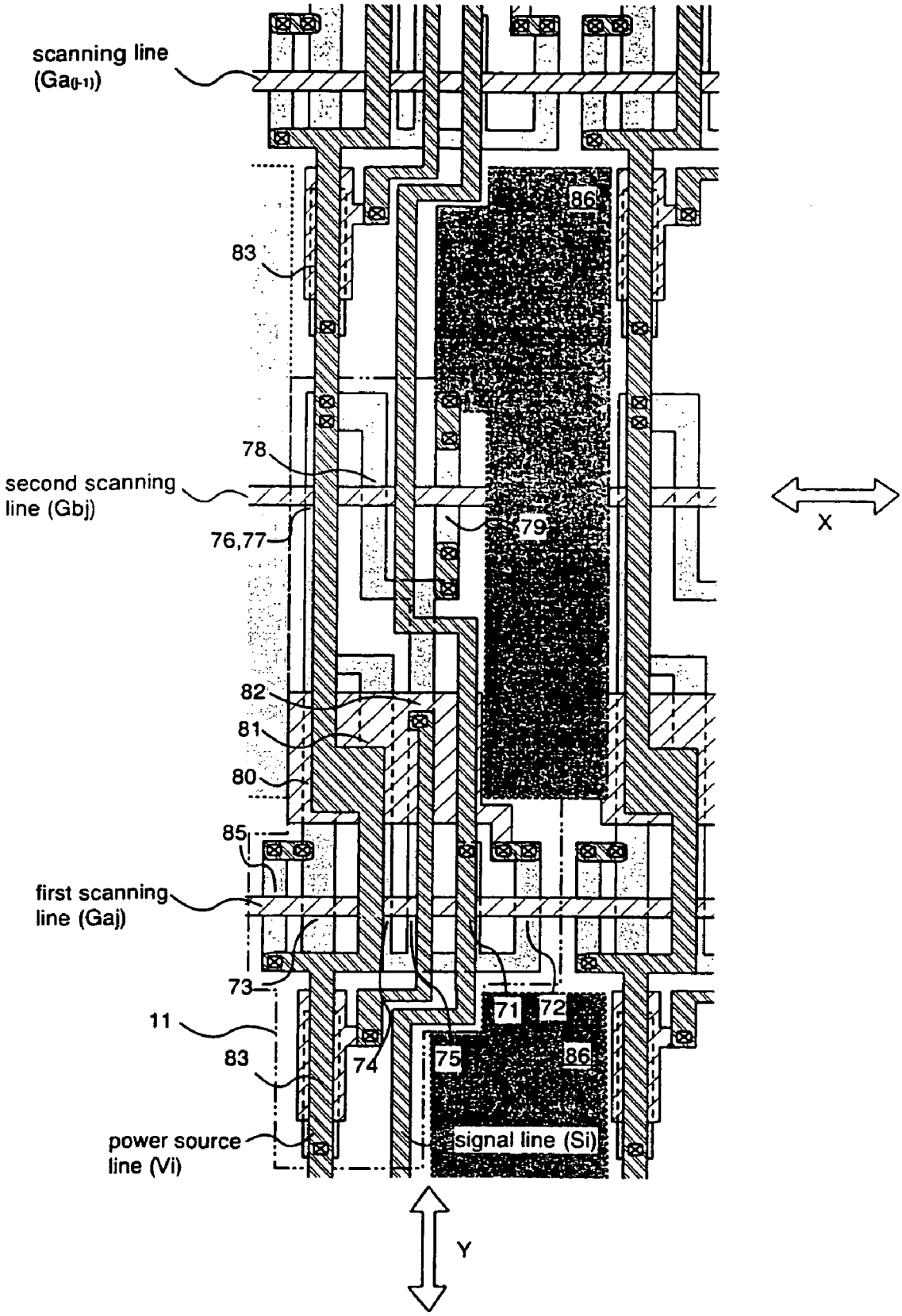
FIG. 6 is a diagram showing a planar layout of a pixel of a display device and a light emitting device of the present invention.

The pixel 11 of the j-th row and the i-th column is shown in FIG. 6. A region surrounded by a double dashed line in FIG.

6 corresponds to the pixel 11. A dotted pattern region is a polysilicon film. Lines slanted up to the right, and double lines slanted down to the right each denote conductive films (metal films or the like) of separate layers. X-shape marks denote interlayer connection points. A checked pattern region 86 corresponds to an anode of a light emitting element 54.

Transistors 71 to 75 and 85 are formed below a first scanning line (Gaj). Transistors 76 to 79 are formed under a second scanning line (Gbj). A capacitor element 83 is formed below a power source line (Vi).

Three transistors 80 to 82 that structure a driver element are formed adjacent to each other with the same size. From the start, therefore, dispersion between the transistors 80 to 82 within the same pixel does not tend to become large. The "parallel write-in, series drive" structure of the present invention is a means of additionally reducing the influence of dispersion originally existing between the plurality of transistors that form the driver element. The effect of the present invention can therefore be greatly utilized, provided that the plurality of transistors used in the driver element have reduced dispersion from the beginning. Dispersion in the brightness of light emitted by the light emitting elements becomes even less significant.

Making the dispersion, which originally exists between the plurality of transistors structuring the driver element, as small as possible is preferable from the standpoint of reducing the driver voltage of the display device and the light emitting device. If the dispersion originally existing between the plurality of transistors that structure the driver element is large, then it is necessary to make the L/W ratio of the plurality of transistors large, and to increase the operation point voltage of the driver element. The driver voltage of the display device and the light emitting device therefore cannot be reduced. This becomes very important for display devices and light emitting devices used for portable equipment having a strong demand for power conservation.

Note that JP 2001-343933 A and the like can be referred to for a method of manufacturing the display device and the light emitting device of the present invention. It is preferable that the source and the drain have symmetry in the plurality of transistors structuring the driver element, but symmetry is not necessarily essential.

Further, if active layers of the transistors 80 to 82 and the like are formed by a polysilicon film, then it is usual at present to first form an amorphous silicon film, and then perform a polycrystallization process. Polycrystallization can be performed by a method such as laser irradiation, SPC (solid state growth), or a combination of laser irradiation and SPC. If irregularities in the laser light intensity and the scanning speed are not made extremely small for cases where microcrystallization is performed by irradiating linear shape laser light while scanning the light, then linear shape irregularities in the polysilicon film will appear, and linear shape irregularities will thus develop in the transistor characteristics.

In order to reduce linear shape irregularities in the transistor characteristics, a scheme may be employed for the laser light scanning direction with respect to the arrangement direction of the transistors structuring the driver element. The laser light scanning may be in a vertical direction, a horizontal direction, or a diagonal direction in the process of manufacturing the display device and the light emitting device of the present invention. Further, laser light scanning may also be performed twice, in the vertical direction and in the horizontal direction, and may also be performed twice in a diagonal direction slanting down from the upper right to the lower left and a diagonal direction slanting down from the upper left to the lower right, in the process of manufacturing the display device and the light emitting device of the present invention. Laser light scanning is performed twice with the layout of FIG. 6, in an x-direction and in a y-direction.

Embodiment Mode 5

Figure 7A:
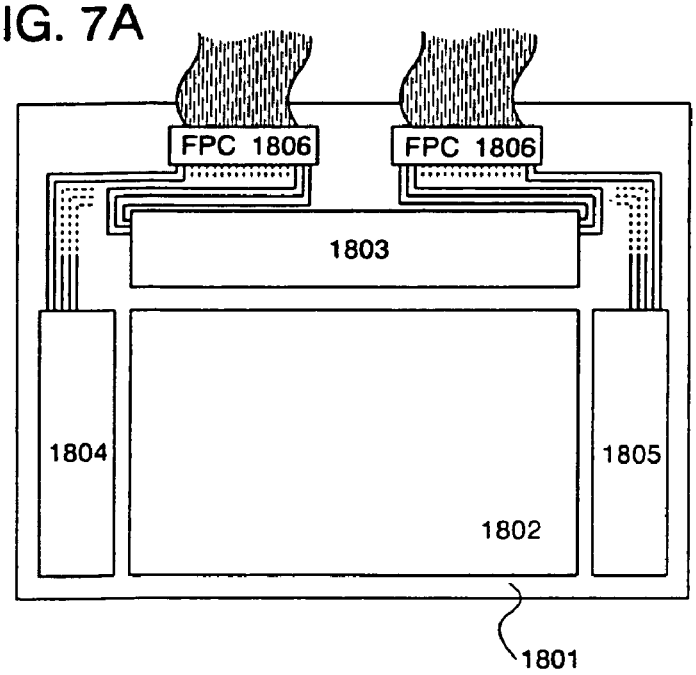
FIGS. 7A to 7C are diagrams showing a display device and a light emitting device of the present invention.
Figure 7B:
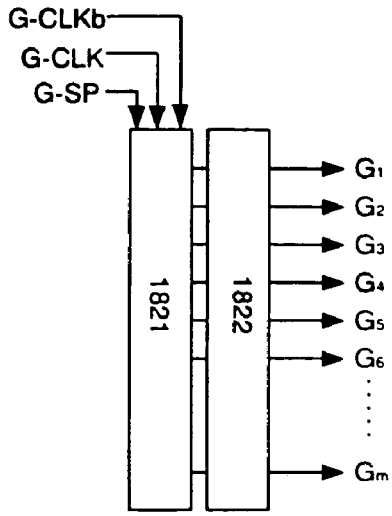
Figure 7C:
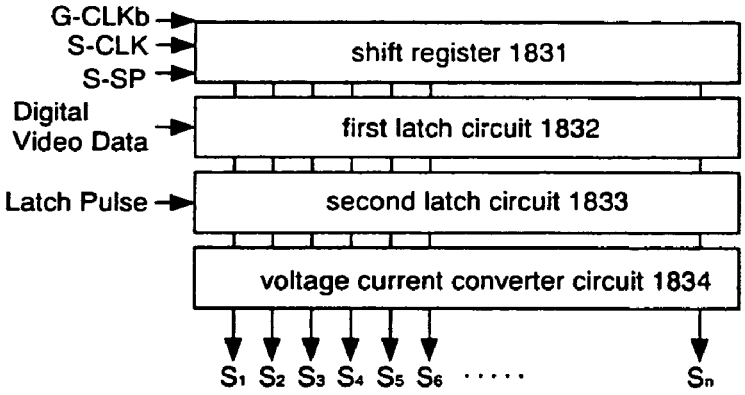

An example of a structure of the display device and the light emitting device of the present invention is explained in Embodiment Mode 5 by using FIGS. 7A to 7C. An example of the general structure of the device, not the internal pixel structure, is explained.

The display device and the light emitting device of the present invention has a pixel portion 1802, in which a plurality of pixels are arranged in a matrix shape, on a substrate 1801. A signal line driver circuit 1803, a first scanning line driver circuit 1804, and a second scanning line driver circuit 1805 are disposed in a periphery portion of the pixel portion 1802. Electric power and signals are supplied from an external portion, through an FPC 1806, to the signal line driver circuit 1803, and the scanning line driver circuits 1804 and 1805.

The signal line driver circuit 1803, and the scanning line driver circuits 1804 and 1805 are integrated in the example of FIG. 7A, but the present invention is not limited to this structure. For example, the second scanning line driver circuit 1805 may be omitted. Alternatively, the signal line driver circuit 1803, and the scanning line driver circuits 1804 and 1805 may be omitted.

Examples of the first scanning line driver circuit 1804 and the second scanning line driver circuit 1805 are explained using FIG. 7B. The scanning line driver circuits 1804 and 1805 each have a shift register 1821 and a buffer circuit 1822 in FIG. 7B.

Circuit operation of FIG. 7B is explained. The shift register 1821 outputs pulses sequentially based on a clock signal (G-CLK), a clock inverted signal (G-CLKb), and a start pulse signal (G-SP). The pulses undergo current amplification by the buffer circuit 1822, after which they are input to scanning lines. The scanning lines are thus placed in a selected state one row at a time.

Note that a level shifter may also be placed within the buffer circuit 1822 when necessary. The level shifter can change the voltage amplitude.

An example of the signal line driver circuit 1803 is explained next using FIG. 7C. The signal line driver circuit 1803 shown in FIG. 7C has a shift register 1831, a first latch circuit 1832, a second latch circuit 1833, and a voltage current converter circuit 1834.

Operation of the circuit of FIG. 7C is explained. The circuit of FIG. 7C is used when employing a digital time gray scale method as a method of displaying intermediate gray scales.

The shift register 1831 outputs pulses sequentially to the first latch circuit 1832 based on a clock signal (S-CLK), a clock inverted signal (S-CLKb), and a start pulse signal (S-SP). Each column of the first latch circuit 1832 successively reads in a digital video signal, in accordance with the pulse timing. When read-in of the video signal is finished through the final column in the first latch circuit 1832, a latch pulse is then input to the second latch circuit 1833. The video signal, which has been written into each column of the first latch circuit 1832. is then transferred all at once to each column of the second latch circuit 1833 by the latch pulse. The video signal, which has been transferred to the second latch circuit 1833, then undergoes suitable shape transformation processing in the voltage current converter circuit 1834, and is transferred to the pixels. On data in the video signal is converted to a current form, and off data is left in its voltage form while undergoing current amplification. After the latch pulse, the shift register 1831 and the first latch circuit 1832 operate to read in the next row of the video signal, and the above operations are repeated.

The structure of the signal line driver circuit 1803 of FIG. 7C is an example, and another structure may be used if an analog gray scale method is employed. Further, other structures can also be used even if a digital time gray scale method is employed.

Embodiment Mode 6

Figure 8A:
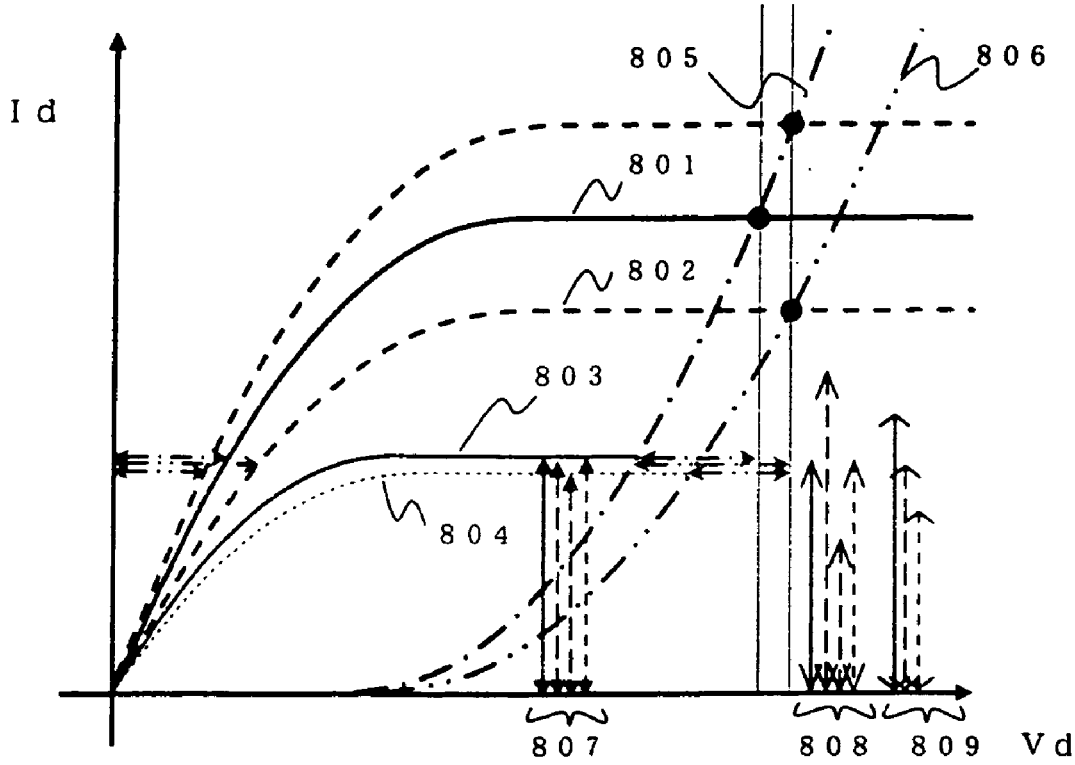
FIGS. 8A and 8B are diagrams showing characteristics of transistors structuring a driver element.
Figure 8B:
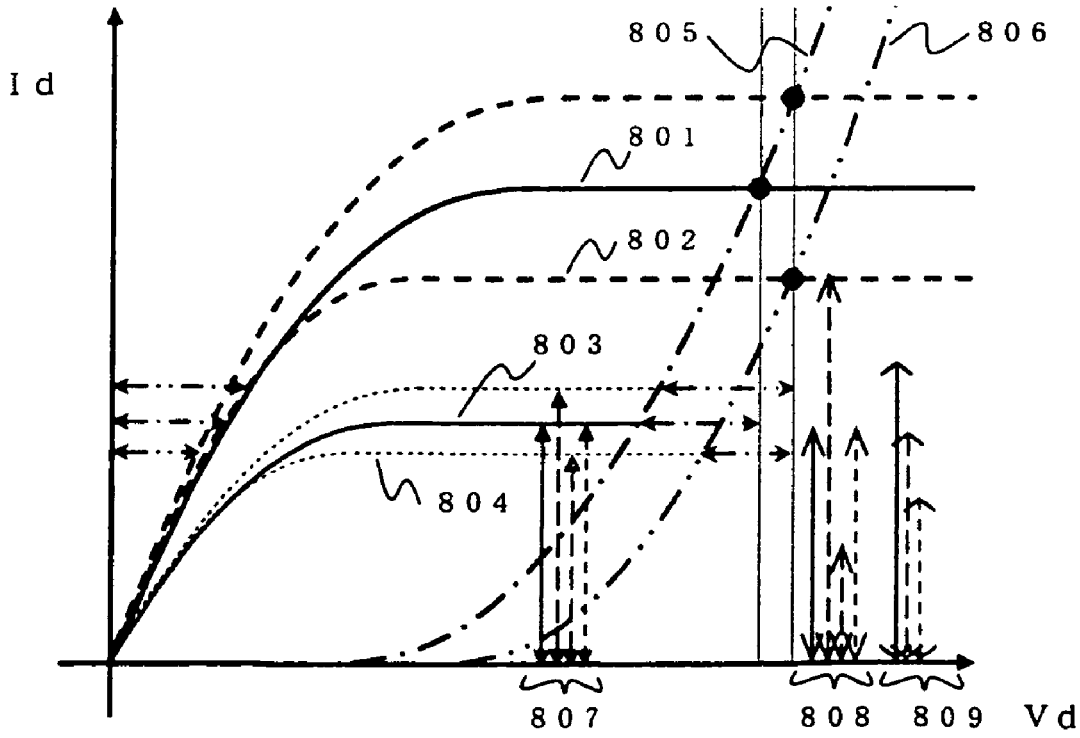

Effects of the present invention are explained in Embodiment Mode 6 using FIGS. 8A and 8B, and FIGS. 17A and 17B. In order to simplify the explanation, an example of a case is explained in which the number of transistors that structure a driver element is two. The specific pixel circuit structure is taken as that shown in FIG. 2A. (Positive and negative directions are appropriately set in FIGS. 8A and 8B, and in FIGS. 17A and 17B. Note that the positive and negative directions will switch if the transistors are p-channel.) Further, the characteristic curve of the transistors of FIGS. 8A and 8B is set to an ideal curve for simplicity, and there is therefore a slight disparity with actual transistors. For example, the channel length variation is zero.

Taking the electric potential of a transistor source as a reference, a gate electric potential is taken as $V_g$, a drain electric potential is taken as $V_d$, and an electric current flowing between the source and the drain is taken as $I_d$. Curves 801 to 804 in FIGS. 8A and 8B are $I_d$-$V_d$ characteristic curves under a certain fixed gate electric potential $V_g$. A bold dashed and dotted curve 805 shows $I_d$-$V_d$ changes, under a condition that $V_g$ and $V_d$ are equal by shorting the gate and the drain, for one of the two transistors structuring the driver element. That is, the bold dashed and dotted curve 805 reflects the transistor specific electrical characteristics (field effect mobility, threshold voltage value). Similarly, a bold dashed and double dotted curve 806 shows $I_d$-$V_d$ changes, under a condition that $V_g$ and $V_d$ are equal by shorting the gate and the drain, for the other one of the two transistors structuring the driver element.

FIGS. 8A and 8B are for graphically investigating what happens to a light emitting element driver current due to the "parallel write-in, series drive" structure of the present invention for cases in which the two transistors structuring the driver element possess different electrical characteristics. FIG. 8A is an example of a case in which the difference in the field effect mobility is particularly large between the two transistors. FIG. 8B is an example of a case in which the threshold voltage value difference is particularly large between the two transistors. The light emitting element driver current for each case is shown by the length of a triangular arrow symbol of triangular arrows 807 in conclusion. These are explained in brief below.

First, consider a case in which the characteristic curves of the transistors 38 and 39 are both equal, corresponding to the bold dashed and dotted curve 805.

The transistors 31 to 36 of FIG. 2B turn on during write-in of a data current. The gate and the drain of the two transistors 38 and 39 structuring the driver element are shorted due to the transistors 31 to 34 turning on. The operation point of the transistors 38 and 39 is therefore a point on the bold dashed and dotted curve 805, and a certain point is determined by the data current value $I_W$. The operation point is here taken as the intersection point of the curves 805 and 801. That is, two times the vertical axis value $I_d$ of the intersection point of the curves 805 and 801 is taken as the data current value $I_W$.

The transistors 31 to 36 of FIG. 2B turn off when the light emitting element emits light, while the transistors 37 and 42 turn on. The gate electric potentials of the transistors 38 and 39 are maintained as is at their values during data current write-in because the transistors 31 to 34 turn off. The transistor 39 operates in the saturated region when the light emitting element emits light, and the transistor 38 operates in the unsaturated region. The $I_d$-$V_d$ curve of the transistor 38 during light emission by the light emitting element is expressed by the curve 801, and the $I_d$-$V_d$ characteristic of the transistor 39 is expressed by the curve 803.

Each dotted line arrow mark in FIG. 8A is equal to the length on the ordinate. During light emission by the light emitting element, the operating point of the transistor 38 is the point of contact between the right end of the left side dotted line arrow and the curve 801. The light emitting element driver current $I_E$ to be found is the ordinate of the dotted line arrow, that is, the length of the solid line triangular arrow of the triangular arrows 807. Note that similar information is also provided on FIG. 8B, and the light emitting element driver current $I_E$ to be found is the length of the solid line triangular arrow of the triangular arrows 807. If the characteristic curve of the transistor 38 and the characteristic curve of the transistor 39 are equal, then the resulting light emitting element driver current $I_E$ to be found becomes one-fourth of the data current value $I_W$.

Next, consider a case in which the characteristics curve of the transistor 38 corresponds to the bold and double dotted curve 806, and the characteristic curve of the transistor 39 corresponds to the bold dashed and dotted curve 805. The data current value $I_W$ is identical to the case discussed above in which the characteristic curves of the transistors 38 and 39 both correspond to the curve 805.

The gate and the drain of each of the two transistors 38 and 39 that structure the driver element of FIG. 2B are shorted during data current write-in. The operating point of the transistor 38 is therefore on the bold and double dotted curve 806, and the operating point of the transistor 39 is on the bold and dotted curve 805. The sum of the ordinate of the operating point of the transistor 38 and the ordinate of the operating point of the transistor 39 is the data current value $I_W$. The operating point of the transistor 38 therefore becomes the intersection of the curves 806 and 802. The operating point of the transistor 39 is equal to the abscissa of the operating point of the transistor 38, and becomes a point on the curve 805.

The transistors 31 to 34 of FIG. 2B turn off when the light emitting element emits light, and therefore the gate electric potentials of the transistors 38 and 39 are maintained as is at their values during data current write-in. The transistor 39 operates in the saturated region when the light emitting element emits light, and the transistor 38 operates in the unsaturated region. The $I_d$-$V_d$ curve of the transistor 38 during light emission by the light emitting element is expressed by the curve 802.

Each dotted line arrow mark in FIG. 8A is equal to the length on the ordinate. The above group of double dotted line arrows is a case whereby the bold double and double dotted curve 806 corresponds to the characteristic curve of the transistor 38, and the bold and dotted curve 805 corresponds to the characteristic curve of the transistor 39 now being considered. During light emission by the light emitting element, the operating point of the transistor 38 is the point of contact between the right end of the left side double dotted line arrow and the curve 802. The light emitting element driver current $I_E$ to be found is the ordinate of the double dotted line arrow, namely the length of the dashed line triangular arrow (left side) of the triangular arrows 807. Note that similar information is also provided on FIG. 8B, and the light emitting element driver current $I_E$ to be found is the length of the dashed line triangular arrow (left side) of the triangular arrows 807.

Further, investigation of a separate case in which the bold and dotted curve 805 corresponds to the characteristic curve of the transistor 38, and the bold and double dotted curve 806 corresponds to the characteristic curve of the transistor 39 can also be performed similarly. Details are not discussed here, but the results show that the light emitting element driver current $I_E$ to be found becomes the length of the dashed line triangular arrow (right side) of the triangular arrows 807 in both FIG. 8A and FIG. 8B.

In addition, a case in which the bold and double dotted curve 805 corresponds to the characteristic curve of both the transistors 38 and 39 can also be similarly investigated. The results show that the light emitting element driver current $I_E$ to be found becomes the length of the short dashed line arrow of the triangular arrows 807 in both FIG. 8A and FIG. 8B.

An outline of how dispersions in the characteristics of the transistors 38 and 39 that structure the driver element are reflected in the light emitting element driver current $I_E$ can be seen from the lengths of the triangular arrows of the triangular arrows 807 in FIGS. 8A and 8B.

Narrow angle arrows 808, and wide angle arrows 809 in FIGS. 8A and 8B are used for comparison. The narrow angle arrows denoted by reference numeral 808 are the results of performing investigations similar to those above when the pixel circuit uses a current input method current mirror. That is, the narrow angle arrows show what happens to the light emitting element driver current $I_E$ when dispersions in the characteristics similar to those above exist between the two transistors of the current mirror. The wide angle arrows 809 are the results of performing similar investigations for a case of a voltage input method pixel circuit. That is, the wide angle arrows show what happens to the light emitting element driver current $I_E$ when dispersions in the characteristics similar to those above exist between light emitting element driver transistors of different pixels.

The following point can be understood by comparing the triangular arrows 807, the narrow angle arrows 808, and the wide angle arrows 809 in FIGS. 8A and 8B.

First, with the triangular shape arrows 807 and the narrow angle arrows 808, the light emitting element driver current $I_E$ becomes a constant whether the characteristic curve of the transistors is the curve 805 or the curve 806, provided that there is no dispersion in the characteristics of the two transistors within the same pixel. That is, it is not necessary that the transistor characteristics be constant over an entire substrate for both pixel circuits using a current input method current mirror, and for the "parallel write-in, series drive" pixel circuit of the present invention. It is sufficient to reduce the dispersion in the characteristics between the two transistors within the same pixel. This point is extremely superior compared to the voltage input method pixel circuit.

However, if dispersion in the characteristics between the two transistors within the same pixels exists, then dispersions in the light emitting element driver current $I_E$ become large as shown by the narrow angle arrows 808. That is, the influence of the dispersion in the characteristics between the two transistors with the same pixel appears intensely with the pixel circuit that uses the current input method current mirror. In extreme cases, there is a danger that the dispersions in the light emitting element driver current $I_E$ will become larger than that found with the voltage input method pixel circuit. In this point, the influence of dispersions in the characteristics between the two transistors within the same pixel is greatly suppressed with the "parallel write-in, series drive" pixel circuit of the present invention. With current day display devices and light emitting devices, dispersion in transistor characteristics over the entire substrate is more series than that within the same pixel. Dispersions in the characteristics between the two transistors within the same pixel therefore does not become a problem in practice provided that it is suppressed to a similar extent as the "parallel write-in, series drive" pixel circuit of the present invention.

Figure 17A:
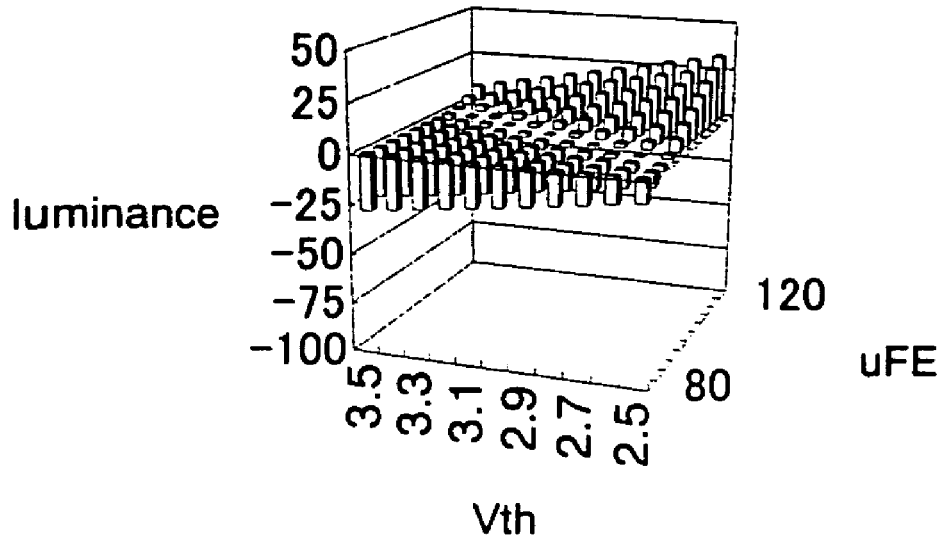
FIGS. 17A and 17B are diagrams showing the display brightness of a light emitting device of the present invention for a cases in which the characteristics of transistors structuring a driver element have been changed.
Figure 17B:
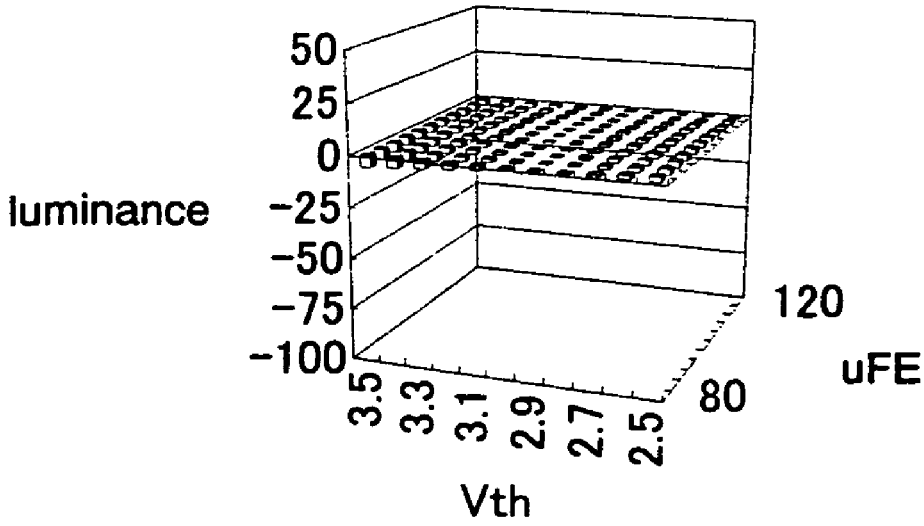

FIGS. 17A and 17B show an example of comparing the pixel circuit using a current input method current mirror, and the "parallel write-in, series drive" pixel circuit of the present invention. First, one transistor of the two transistors within the same pixel is fixed to standard value characteristics in FIGS. 17A and 17B. The standard value of a field effect mobility uFE is taken as 100, and the standard value of a threshold value Vth is taken as 3 V. The value of the brightness of light emission was simulated across different values for the characteristics of the other transistor within the same pixel. Values for the field effect mobility uFE were varied in a range from 80 to 120, and values for the threshold value Vth were varied from 2.5 V to 3.5 V. The brightness value for light emission was standardized so that the brightness value is zero when the two transistors within the same pixel have standard value characteristics, and the brightness value is −100 when the pixel is turned off.

FIG. 17A is for the case of the pixel circuit that uses a current input method current mirror, and FIG. 17B is for the case of the "parallel write-in, series drive" pixel circuit of the present invention. Dispersion in the characteristics between the two transistors within the same pixel depends greatly on manufacturing processes. However, with present day standard manufacturing processes, values for the field effect mobility uFE and for the threshold value Vth as shown in FIGS. 17A and 17B are not unusual. In general, it can be seen that there is a possibility of display irregularities on the order of plus or minus 25% developing for the case of the pixel circuit that uses a current input method current mirror. On the other hand, it can be seen that display irregularities can be suppressed to within a range permissible for practical use with the "parallel write-in, series drive" pixel circuit of the present invention.

Note that, for convenience, the simulations of FIGS. 17A and 17B were performed with realistic arbitrary values for transistor structural parameters. By varying the operating transistor operating voltage by changing the transistor structural parameters, it can be seen that brightness dispersions are reduced as the operating voltage becomes higher.

The effects of the present invention for an example of a case in which the number of transistors n structuring the driver element is two are explained in Embodiment Mode 6. However, similar results are also established for cases in which the number of transistors n structuring the driver element is three or greater. Note that the effect of reducing dispersions in the TFT characteristics becomes weaker as the number of transistors n structuring the driver element increases. Conversely, the applicants of the present invention have found that, when considering the structure and characteristics (including electrical resistance and parasitic capacitance of wirings and the like, in addition to TFT characteristics) of a polysilicon TFT substrate capable of being manufactured at present, along with the light emitting characteristics of OLED elements, it is preferable for the data current value $I_W$ to be equal to or greater than 5 times the light emitting element driver current $I_E$ for cases in which the present invention is applied to an AM-OLED display device. Setting the number of transistors n structuring the driver element on the order of 3 to 5 therefore has a high utility value. There are cases in which a high utility can be achieved with other values of n depending upon the display device application and the driving method.

Further, in addition to the fact that ideal values for the transistor characteristics are used in Embodiment Mode 6, parasitic resistance, on resistance for transistors connected in series, and the like are ignored. In reality, these do impart some influence. However, this does not change the fact that the "parallel write-in, series drive" of the present invention is effective in suppressing display irregularities.

Embodiment Mode 7

In Embodiment Mode 7, electronic equipment and the like having the display devices and the light emitting devices of the present invention mounted thereon will be exemplified.

Examples of electronic equipment having the display devices and light emitting devices of the present invention mounted thereon include monitors, video cameras, digital cameras, goggle type displays (head mounted displays), navigation systems, audio reproduction devices (car audios, audio components, etc.), notebook type personal computers, game machines, portable information terminals (mobile computers, mobile telephones, portable game machines, and electronic books, etc.), image reproduction devices equipped with a recording medium (specifically, devices equipped with a display capable of reproducing the recording medium such as a digital versatile disk (DVD), etc. and displaying the image thereof), and the like. In particular, as to an electronic equipment whose screen is often viewed from a diagonal direction, since a wide angle of view is regarded as important, the light emitting device is desirably used. Specific examples of these electronic equipment are shown in FIG. 9.

Figure 9A:
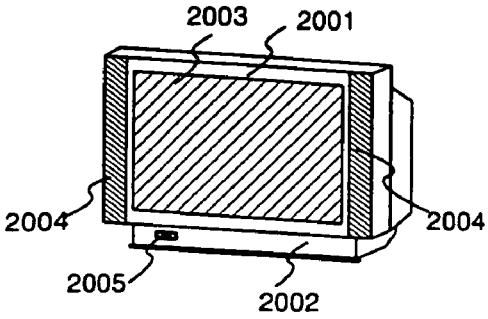
FIGS. 9A to 9H are diagrams showing electronic equipment to which a display device and a light emitting device of the present invention are applied.

FIG. 9A is a monitor which, in this example, is composed of a frame 2001, a support base 2002, a display portion 2003, a speaker portion 2004, a video input terminal 2005, and the like. The display device and the light emitting device of the present invention can be used in the display portion 2003. As the light emitting device is of a light emitting type, there is no need for a backlight, whereby it is possible to obtain a thinner display portion than that of a liquid crystal display device. Note that the term monitor includes all the display devices for displaying information, such as for personal computers, for receiving TV broadcasting, and for advertising.

Figure 9B:
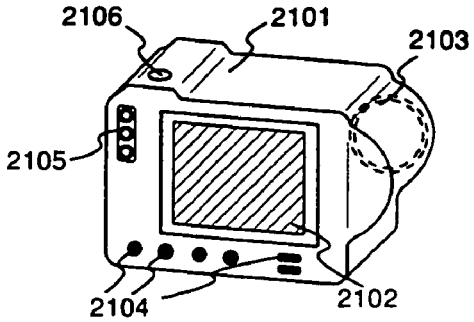

FIG. 9B is a digital still camera which, in this example, is composed of a main body 2101, a display portion 2102, an image-receiving portion 2103, operation keys 2104, an external connection port 2105, a shutter 2106, and the like. The display device and the light emitting device of the present invention can be used in the display portion 2102.

Figure 9C:
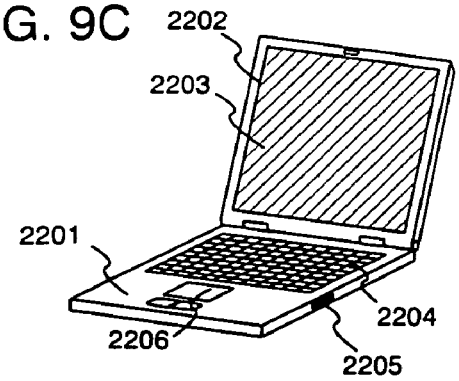

FIG. 9C is a notebook type personal computer which, in this example, is composed of a main body 2201, a frame 2202, a display portion 2203, a keyboard 2204, an external connection port 2205, a pointing mouse 2206, and the like. The display device and the light emitting device of the present invention can be used in the display portion 2203.

Figure 9D:
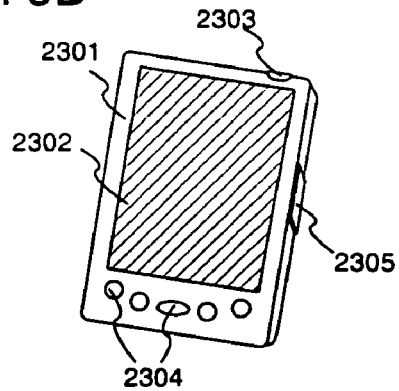

FIG. 9D is a mobile computer which, in this example, is composed of a main body 2301, a display portion 2302, a switch 2303, operation keys 2304, an infrared port 2305, and the like. The display device and the light emitting device of the present invention can be used in the display portion 2302.

Figure 9E:
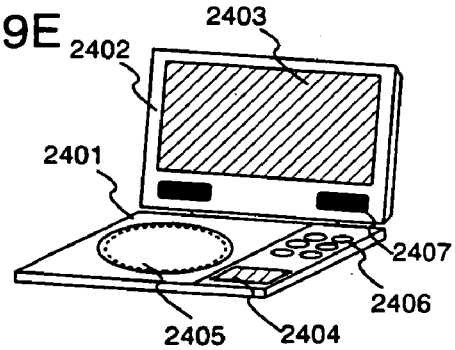

FIG. 9E is a portable image reproduction device provided with a recording medium (specifically, a DVD reproduction device which, in this example, is composed of a main body 2401, a frame 2402, a display portion A 2403, a display portion B 2404, a recording medium (such as a DVD) read-in portion 2405, operation keys 2406, a speaker portion 2407, and the like. The display device and the light emitting device of the present invention can be used in the display portion A 2403 and in the display portion B 2404. Note that image reproduction devices provided with a recording medium include game machines for domestic use and the like.

Figure 9F:
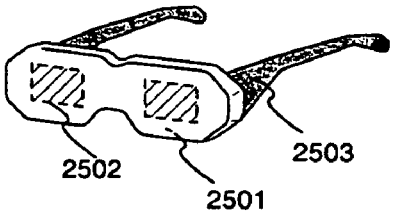

FIG. 9F is a goggle type display (head mounted display) which, in this example, is composed of a main body 2501, a display portion 2502, an arm 2503, and the like. The display device and the light emitting device present invention can be used in the display portion 2502.

Figure 9G:
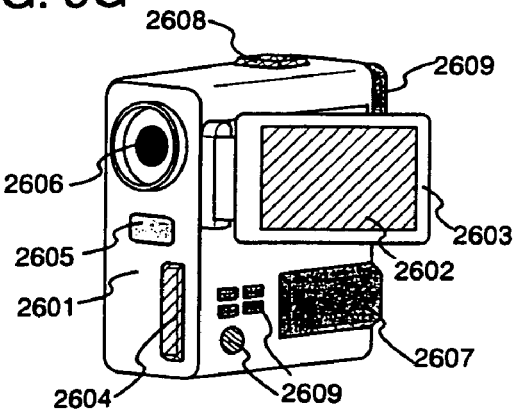

FIG. 9G is a video camera which, in this example, is composed of a main body 2601, a display portion 2602, a frame 2603, an external connection port 2604, a remote control receiving portion 2605, an image receiving portion 2606, a battery 2607, an audio input portion 2608, operation keys 2609, an eyepiece portion 2610, and the like. The display device and the light emitting device of the present invention can be used in the display portion 2602.

Figure 9H:
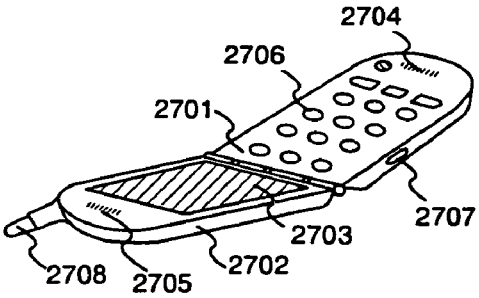

FIG. 9H is a mobile telephone which, in this example, is composed of a main body 2701, a frame 2702, a display portion 2703, an audio input portion 2704, an audio output portion 2705, operation keys 2706, an external connection port 2707, an antenna 2708, and the like. The display device and the light emitting device of the present invention can be used in the display portion 2703. Note that by displaying white characters on a black background, the display portion 2703 can suppress the power consumption of the mobile telephone.

Note that if the light emitting intensity of the light emitting elements can be increased in the future, the light including the image information output from the display device and the light emitting device of the present invention can be enlarged and projected with a lens or the like, whereby it is possible to use the projected light in front type projectors or rear type projectors.

As has been described, the application range of the present invention is so wide that it is possible to use the present invention in electronic equipment and the like of any field.

Driver elements disposed in each pixel in an active matrix display device and in a light emitting device are structured by a plurality of transistors in the present invention. The plurality of transistors are placed in a parallel connection state during write-in of a data current to the pixels, and the plurality of transistors are placed in a series connection state when light emitting elements emit light. The connection state of the plurality of transistors structuring the driver element is thus suitably switched between parallel and series. The following effects develop as a result.

Figure 10A:
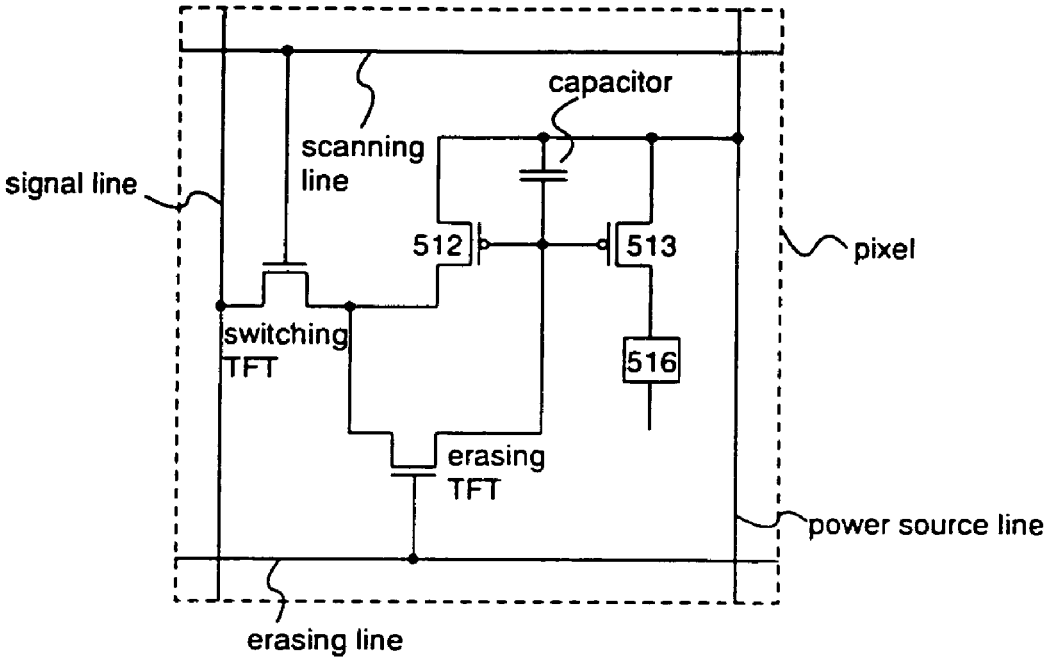
FIG. 10A Prior Art
FIGS. 10A and 10B are diagrams showing a pixel of a known display device and a known light emitting device.

First, a very large defect with display quality in which irregularities in the brightness of emitted light appear over an entire display screen, if there are no dispersions even in the plurality of transistors structuring a driver element within the same pixel, can be avoided. Namely, the electrical characteristics of the transistors possess a great deal of dispersion when viewed across an entire substrate. This dispersion is reflected in the light emitting element driver current $I_E$, and irregularities in the brightness of emitted light across the entire display screen can be prevented. Note that irregularities in the brightness of emitted light across the entire display screen can also be prevented in pixel circuits that use the current mirror of FIG. 10A, provided that there is no dispersion in the two transistors of the current mirror within the same pixel. In this manner the present invention has an effect similar to cases of pixel circuits that use current mirrors like those of FIG. 10A.

However, the brightness of emitted light cannot be prevented from differing across pixels if dispersion exists between the two transistors within the same pixel with the pixel circuit that uses a current mirror like that of FIG. 10A. In this point, even if dispersions exist across the plurality of transistors structuring the drive element within one pixel, the influence of the dispersions can be greatly suppressed in the case of the present invention, and therefore irregularities in the brightness of emitted light across pixels, of an order such that it can cause problems during practical use, can be prevented.

Figure 10B:
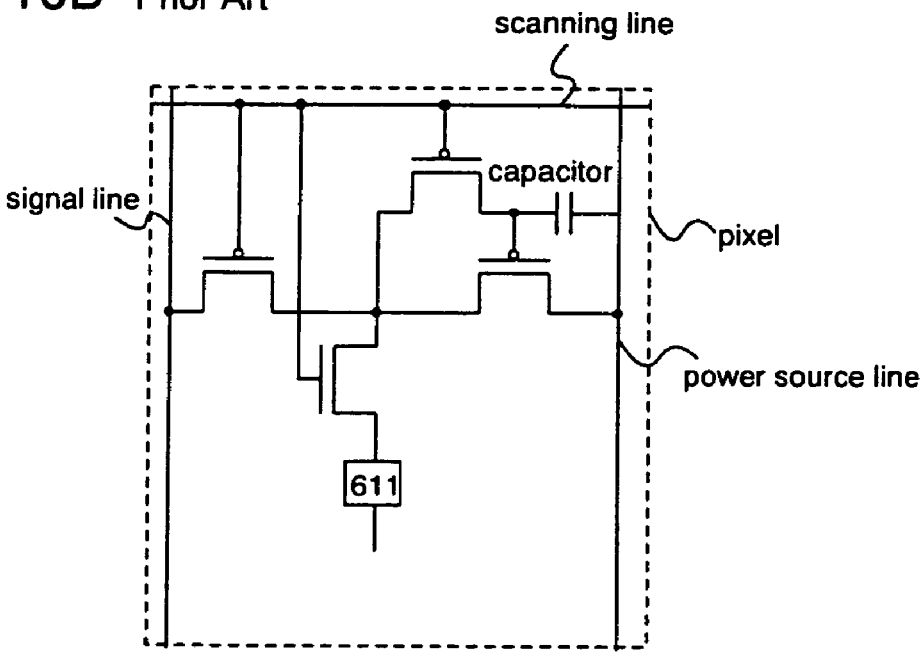
FIG. 10B Prior Art
Figure 11A:
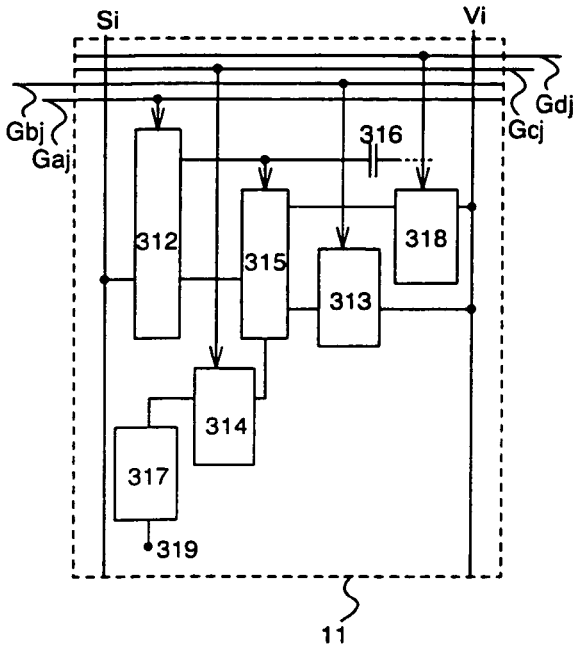
FIGS. 11A to 11D are diagrams showing a pixel of a display device and a light emitting device of the present invention.
Figure 11B:
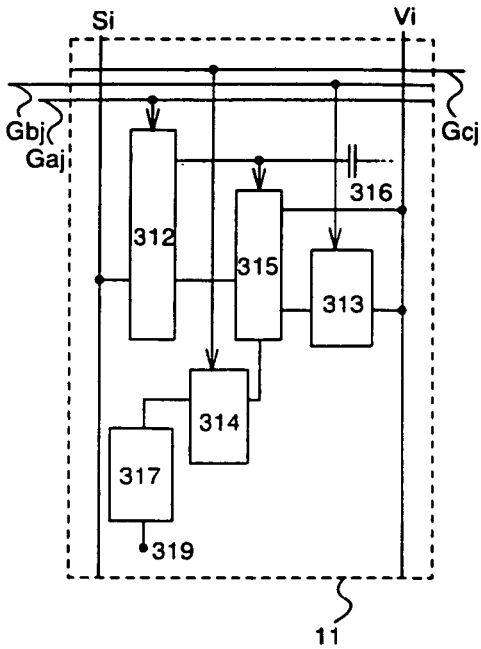
Figure 11C:
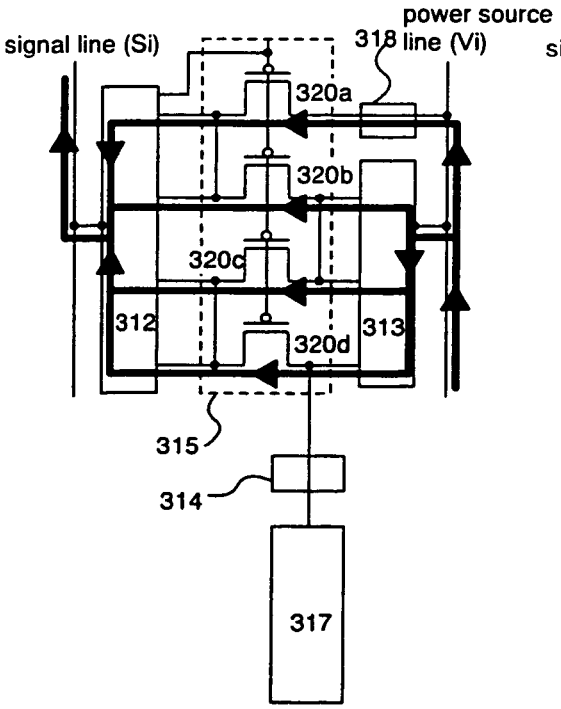
Figure 11D:
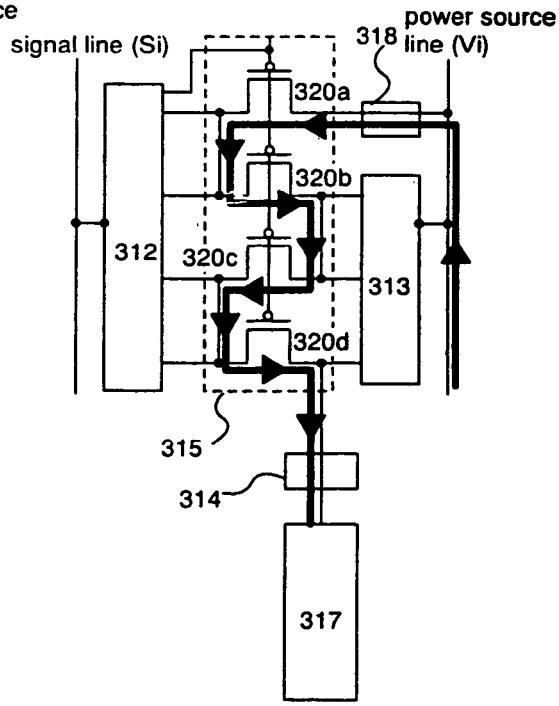

Further, dispersions in the brightness of emitted light across pixels can be prevented for the case of the pixel circuit of FIG. 10B. However, the ratios of the pixel write-in data current $I_W$ and the light emitting element driver current $I_E$ during light emission by the light emitting elements must have identical values for the pixel circuit of FIG. 10B. This is an extremely severe restriction in practice. With the present invention, the transistors that structure the driver element are divided into a plurality, and therefore it is possible to make the pixel write-in data current $I_W$ written into the pixels larger than the light emitting element driver current $I_E$.

The present invention has advantages like those stated above, and therefore is an important technique for manufacturing practical active matrix display devices and light emitting devices.

What is claimed is:

1. A portable information terminal comprising:

a display portion attached to a main body of the portable information terminal; and a pixel in the display portion, the pixel comprising:

a driver element comprising a plurality of transistors, wherein the plurality of transistors are placed in a series connection state to flow electric current when the pixel performs display, and wherein the plurality of transistors are placed in a parallel connection state to flow electric current when data is written into the pixel.

2. A portable information terminal according to claim 1, wherein the portable information terminal is at least one selected from the group consisting of a mobile computer, a mobile telephone, a portable game machine, and an electronic book.

3. A goggle type display comprising:

a display portion attached to a main body of the goggle type display; and a pixel in the display portion, the pixel comprising:

a driver element comprising a plurality of transistors, wherein the plurality of transistors are placed in a series connection state to flow electric current when the pixel performs display, and wherein the plurality of transistors are placed in a parallel connection state to flow electric current when data is written into the pixel.

4. A camera comprising:

a display portion attached to a main body of the camera; and a pixel in the display portion, the pixel comprising:

a plurality of transistors; and a means for switching a connection state between the plurality of transistors to one of a series connection state and a parallel connection state.

5. A camera according to claim 4, wherein the camera is at least one of a digital camera and a video camera.

6. A personal computer comprising:

a display portion attached to a main body of the personal computer; and a pixel in the display portion, the pixel comprising:

a plurality of transistors; and a means for switching a connection state between the plurality of transistors to one of a series connection state and a parallel connection state.

7. An image reproduction device comprising:

a display portion attached to a main body of the image reproduction device; and a pixel in the display portion, the pixel comprising:

a plurality of transistors; and a means for switching a connection state between the plurality of transistors to one of a series connection state and a parallel connection state.

8. An image reproduction device according to claim 7, wherein the image reproduction device is a DVD.

9. A goggle type display comprising:

a display portion attached to a main body of the goggle type display; and a pixel in the display portion, the pixel comprising:

a plurality of transistors; and a means for switching a connection state between the plurality of transistors to one of a series connection state and a parallel connection state.

10. A portable information terminal comprising:

a display portion attached to a main body of the portable information terminal; and a pixel in the display portion, the pixel comprising:

a plurality of transistors; and a means for switching a connection state between the plurality of transistors to one of a series connection state and a parallel connection state.

11. A portable information terminal according to claim 10, wherein the portable information terminal is at least one selected from the group consisting of a mobile computer, a mobile telephone, a portable game machine, and an electronic book.

12. A camera comprising:

a display portion attached to a main body of the camera; and a pixel in the display portion, the pixel comprising:

a driver element comprising a plurality of transistors, wherein the plurality of transistors are placed in a series connection state to flow electric current when the pixel performs display, and wherein the plurality of transistors are placed in a parallel connection state to flow electric current when data is written into the pixel.

13. A camera according to claim 12, wherein the camera is at least one of a digital camera and a video camera.

14. A personal computer comprising:

a display portion attached to a main body of the personal computer; and a pixel in the display portion, the pixel comprising:

a driver element comprising a plurality of transistors, wherein the plurality of transistors are placed in a series connection state to flow electric current when the pixel performs display, and wherein the plurality of transistors are placed in a parallel connection state to flow electric current when data is written into the pixel.

15. An image reproduction device comprising:

a display portion attached to a main body of the image reproduction device; and a pixel in the display portion, the pixel comprising:

a driver element comprising a plurality of transistors, wherein the plurality of transistors are placed in a series connection state to flow electric current when the pixel performs display, and wherein the plurality of transistors are placed in a parallel connection state to flow electric current when data is written into the pixel.

16. An image reproduction device according to claim 15, wherein the image reproduction device is a DVD.

* * * * *